US006286940B1

(12) United States Patent
Sugiyama et al.

(10) Patent No.: US 6,286,940 B1
(45) Date of Patent: Sep. 11, 2001

(54) METHOD FOR DISCHARGE OF LIQUID AND LIQUID DISCHARGE HEAD

(75) Inventors: Hiroyuki Sugiyama, Sagamihara; Hiroyuki Ishinaga, Tokyo; Toshio Kashino, Chigasaki; Aya Yoshihira, Yokohama; Kiyomitsu Kudo, Kawasaki; Yoichi Taneya; Satoshi Shimazu, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/089,481

(22) Filed: Jun. 2, 1998

(30) Foreign Application Priority Data

Jun. 6, 1997 (JP) ..... 9-149384

(51) Int. Cl.[7] ..... B41J 2/05
(52) U.S. Cl. ..... 347/65
(58) Field of Search ..... 347/63, 65, 67

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,480,259 * | 10/1984 | Kruger et al. | 347/65 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,208,604 | 5/1993 | Watanabe et al. | 347/47 |
| 5,278,585 | 1/1994 | Karz et al. | 347/65 |
| 5,389,957 | 2/1995 | Kimura et al. | 347/20 |
| 5,467,112 | 11/1995 | Mitani | 347/1 |

FOREIGN PATENT DOCUMENTS

| | | |
|---|---|---|
| 0 721 843 | 7/1996 | (EP) . |
| 0 811 492 | 12/1997 | (EP) . |
| 54-56847 | 5/1979 | (JP) . |
| 61-59911 | 5/1979 | (JP) . |
| 61-59914 | 2/1980 | (JP) . |
| 55-81172 | 6/1980 | (JP) . |
| 59-26270 | 2/1984 | (JP) . |
| 59-123670 | 7/1984 | (JP) . |
| 59-138461 | 8/1984 | (JP) . |
| 60-71260 | 4/1985 | (JP) . |
| 1-247168 | 10/1989 | (JP) . |
| 2-137930 | 5/1990 | (JP) . |
| 4-329148 | 11/1992 | (JP) . |
| 5-229122 | 9/1993 | (JP) . |

* cited by examiner

*Primary Examiner*—John E. Barlow, Jr.
*Assistant Examiner*—Juanita Stephens
(74) *Attorney, Agent, or Firm*—Fitzpatrick, Cella, Harper & Scinto

(57) ABSTRACT

A method for the discharge of a liquid and a liquid discharge head are provided which produce stable discharge of the liquid and, at the same time, facilitate the supply of the liquid by repressing the oscillation of a movable separation membrane during the extinction of bubbles. The method comprises using a movable separation membrane for separating a first flow path communicating with a discharge port for discharging the liquid and a second flow path furnished with a bubble generating region for generating bubbles in the liquid by the use of a heating element, disposing a movable member opposed to the bubble generating region across the movable separation membrane and furnished with a free terminal in the direction of liquid discharge, causing separation between the movable separation membrane and the movable member during the contraction of the bubbles, and inducing the intrusion of the liquid therebetween.

39 Claims, 15 Drawing Sheets

METHOD FOR DISCHARGE OF LIQUID AND LIQUID DISCHARGE HEAD

BACKGROUND OF THE INVENTION

1. Field of the Invention

This invention relates to a method for discharge of a liquid wished to be discharged and a liquid discharge head which resort to generation of bubbles by means of thermal energy, for example, and more particularly to a method for the discharge of a liquid and a liquid discharge head which rely on the use of a movable separation membrane capable of effecting displacement of its own in consequence of the generation of bubbles.

The term "record" as used herein means not merely the action of imparting images such as characters and figures which have meanings to a recording medium but also the action of imparting figures such as patterns which are destitute of meaning to the recording medium.

2. Related Background Art

The so-called bubble jet recording medium, i.e. the version of ink jet recording method which effects the formation of an image on a recording medium by exerting the energy of heat, for example, on an ink thereby causing the ink to produce a change of state accompanied by an abrupt volumetric change (generation of bubbles) and thereby enabling the force of action due to this change of state to discharge the ink through a discharge port and allowing the discharged ink to adhere to the recording medium, has been heretofore known to the art. The recording device which utilizes this bubble jet recording method, as disclosed in JP-B-61-59911 and JP-B-61-59914, is generally furnished with a discharge port for allowing the discharge of ink, an ink flow path communicating with the discharge port, and a heating element (electrothermal converting element) disposed in the ink flow path and adapted as an energy generating means for effecting the discharge of ink.

The recording method described above enjoys many fine features such as permitting easy production of recorded images and further color images of high resolution by the use of a small device because this recording method enables images of high quality to be recorded at high speed with low noise and the head embodying this recording method permits discharge ports for the discharge of this ink to be disposed in high density. The bubble jet recording method, therefore, has come to be utilized in recent years in numerous office devices such as printers, copying devices, and facsimile devices. It is now on the verge of finding utility in industrial applications such as for a printing device.

In the conventional bubble jet recording method, since the heating element held in contact with the ink repeats application of heat to the ink, it has the possibility of scorching the ink and forming on the surface thereof a deposit of scorched ink. When the liquid wished to be discharged is apt to be deteriorated by heat or it is not easily allowed to foam sufficiently, there are times when the formation of bubbles by direct heating with the heating element mentioned above will fail to bring about perfect discharge of the liquid.

The present applicant has proposed in JP-A-55-81172 a method for effecting discharge of a discharging liquid by foaming the bubble generating liquid with a thermal energy applied thereto through the medium of a flexible membrane adapted to separate the bubble generating liquid and the discharging liquid. This method is constructed such that the flexible membrane and the bubble generating liquid are disposed in part of a nozzle. In contrast, a construction using a large membrane capable of separating the head in its entirety into an upper and a lower part is disclosed in JP-A-59-26270. This large membrane is aimed at enabling a liquid flow path to be interposed between two plate members and consequently preventing liquids held back by the two plate members from mingling with each other.

As ideas that take consideration of foaming properties which are characteristic of bubble generating liquids themselves, an invention of JP-A-05-229122 which uses a liquid having a lower boiling point than a discharging liquid and an invention of JP-A-04-329148 which uses an electroconductive liquid as a bubble generating liquid have been also known to the art.

The conventional method for discharge of liquid by the use of a separation membrane has not reached a level of feasibility because it is constructed solely for the separation of a bubble generating liquid and a discharging liquid or is intended only for improving the bubble generating liquid itself.

The present inventors have pursued a study on the discharge of liquid drops by the use of a separator, with emphasis on the liquid drops subjected to discharging, and have consequently reached a conclusion that the discharge of liquid brought about by the formation of bubbles with the thermal energy has the efficiency thereof degraded through the intervention of the aging of the separation membrane and has not yet been reduced to practice.

The present inventors, therefore, have initiated a study in search of a method for discharge of liquid and a device therefor which can utilize the effect the function of separation by the separation membrane and meanwhile exalt the discharge of liquid to a higher level. The present invention has originated in the course of this study and is directed to providing an epochal method of discharge and a device therefor which can improve the efficiency of discharge of liquid drops and can stabilize and exalt the volume of liquid drops to be discharged and the speed of discharge of liquid drops. Specifically, this invention resides in a liquid charge head furnished with a first flow path used for a discharging liquid and adapted to communicate with a discharge port, a second flow path adapted to supply or transfer a bubble generating liquid and embrace a bubble generating region, and a movable separation membrane for separating the first and the second flow path, which features the ability to improve the efficiency of discharge.

The present inventors, particularly concerning the liquid discharge head disclosed in JP-A-5-229122, have demonstrated that a small empty space destined to serve as a bubble generating region is disposed on the upstream side of a discharge port relative to the direction of the flow of a discharging liquid, that the bubble generating region itself barely has the same width and length as a heating element, that when the bubble generating region emits bubbles, a flexible membrane is displaced by the generation of the bubbles only in the vertical direction relative to the direction of discharge of the discharging liquid, and that the liquid discharge head consequently entails the problem of producing no sufficient discharging speed and performing no efficient discharging motion. The inventors, regarding the cause for this problem, have taken notice of the fact that the same bubble generating liquid always uses repeatedly the closed small empty space and have ultimately realized the production of an efficient discharging motion by virtue of the present invention.

The present invention has been produced in the light of the problem encountered by the prior art as mentioned above. The first object of this invention is to provide, in a construction for substantially separating, preferably perfectly separating, a discharging liquid and a bubble generating liquid by means of a movable separation membrane, a method for the discharge of liquid and a liquid discharge head which, while the force generated by the pressure of bubbles is deforming the movable separation membrane and transferring the pressure to the discharging liquid, not only prevent the pressure from escaping toward the upstream side but also guide the pressure in the direction of the discharge port and give rise to a high discharging force without a sacrifice of the efficiency of discharging. The second object of this invention is to provide a method for the discharge of liquid and a liquid discharge head which, owing to the construction described above, allow a decrease in the amount of a deposit suffered to pile on a heating element and permit efficient discharge of liquid without inflicting a thermal effect on the discharging liquid. The third object of this invention is to provide a method for the discharge of liquid and a liquid discharge head which enjoy broad freedom of selection without reference to the viscosity of the discharging liquid or the composition of the material thereof.

Specifically, the major object of this invention resides in providing a method for the discharge of liquid and a liquid discharge head which, besides fulfilling the objects mentioned above, repress the vibration of the movable separation membrane during the extinction of bubbles, effect stable discharge, promote supply of liquid, and improve the property of refilling.

SUMMARY OF THE INVENTION

The means which the present invention adopts for fulfilling the objects mentioned above will be described below.

The method for the discharge of a liquid according to this invention comprises a step of effecting discharge of a liquid aimed at by causing a movable separation membrane which constantly keeps in a substantially separated state a first flow path adapted to discharge a liquid and communicate with a discharge port and a second flow path provided with a bubble generating region for generating bubbles in a liquid to be displaced with the bubbles mentioned above on the upstream side of the discharge port mentioned above relative to the flow of the liquid in the first flow path, which method is characterized by restraining the meniscus of the liquid from retracting relative to the displacement of the movable separation membrane in response to the expansion·contraction of the bubbles by means of a regulating member.

The method is further characterized by incorporating in the process for the retraction of the meniscus a step of interposing the liquid between the movable separation membrane and the regulating member held in contact with a displacing region of the movable separation membrane and furnished with a free end on the discharge port side for restraining the displacement while they are in a state in which they are separated at least partly from each other.

The method is further characterized by separating the movable separation membrane and a movable member, i.e. the regulating member mentioned above, during the contraction of the bubbles mentioned above thereby inducing intrusion of the liquid therebetween and allowing them to return to their home positions.

The method is further characterized by effecting the intrusion of the liquid between the movable separation membrane and the movable member mentioned above by means of a liquid intrusion promoting mechanism provided for the movable member.

Incidentally, as a device for specifically executing the step of displacement, i.e. one of the characteristics of this invention mentioned above, the construction which will be described herein below may be cited. Other constructions which are embraced in the technical idea of this invention and are capable of accomplishing the step of displacement are included in the present invention.

The term "regulating member" which will be mentioned herein below embraces the construction of the movable separation membrane itself (such as, for example, the distribution of modulus of elasticity and the combination of a deformable elongating part and a nondeformable part) or an additive member adapted to act on the movable separation membrane, or the construction of the first flow path, or a varying combination thereof.

The liquid discharge head according to this invention comprises a first flow path adapted to discharge a liquid and communicate with a discharge port, a second flow path furnished with a bubble generating region for generating bubbles in a liquid, and a movable separation membrane for effecting substantial separation between the first and the second flow path and operates to effect discharge of the liquid by displacing the movable separation membrane with the bubbles mentioned above on the upstream side of the discharge port relative to the flow of the liquid in the first flow path, which liquid discharge head is characterized by being provided with a regulating member for restraining the retraction of the meniscus of the liquid relative to the displacement of the movable separation membrane in response to the growth and contraction of bubbles.

The liquid discharge head is further characterized by being provided with a regulating member held in contact with a displacing region of the movable separation membrane mentioned above and furnished with a free end on the discharge port side for restraining the displacement thereof and a device for restraining the amount of relative motion of the movable separation membrane and the regulating member in consequence of the retraction of the meniscus.

The liquid discharge head according to this invention comprises a movable separation membrane for substantially separating a bubble generating region for generating bubbles in a liquid and a liquid discharge region communicating with a discharge port for discharging a liquid, an energy generating device for generating bubbles in the bubble generating region mentioned above, and a movable member furnished with a free end in the direction of the discharge port opposed to the bubble generating region through the medium of the movable separation membrane, which liquid discharge head is characterized by the fact that the movable separation membrane and the movable member are separated from each other during the contraction of the bubbles.

The liquid discharge head of this invention is further characterized by the fact that the free end of the movable member is approximated closely to the discharge port until it contact the meniscus.

The liquid discharge head of this invention is further characterized by the fact that the free end of the movable member mentioned above is provided on the upstream side of the point directly above the discharge port side end of the heating element, i.e. the energy generating device mentioned above.

The liquid discharge head of this invention is further characterized by the fact that the movable member mentioned above is provided with a liquid intrusion promoting structure for the intrusion of liquid between the movable separation membrane and the movable member mentioned above.

The liquid discharge head of this invention is further characterized by the fact that the liquid intrusion promoting structure mentioned above is a feed opening provided in the movable members.

The liquid discharge head of this invention is further characterized by the fact that the liquid intrusion promoting structure mentioned above is a tight adhesion preventing structure for preventing the movable member and the movable separation membrane from tightly adhering to each other.

The liquid discharge head of this invention is further characterized by the fact that the tight adhesion preventing structure is a convex point provided in a region in which the movable member contacts the movable separation membrane.

The liquid discharge head of this invention is further characterized by the fact that the tight adhesion preventing structure mentioned above is a liquid inflow groove provided on the movable separation membrane side of the movable member.

The liquid discharge head of this invention is further characterized by the fact that the movable member mentioned above is retained in a tilted state in the first flow path.

The liquid discharge head of this invention is further characterized by the fact that a heating element for emitting the heat for the generation of bubbles mentioned above is provided at a position at which the bubble generating region is opposed to the movable member.

The liquid discharge head of this invention is further characterized by the fact that the downstream part of the bubbles generated in the bubble generating region comprises the bubbles which are generated on the downstream side from the center of the area of the heating element mentioned above.

The liquid discharge head of this invention is further characterized by the fact that the movable member mentioned above has the free end thereof mentioned above positioned on the discharge port side from the center of the area of the heating element.

The liquid discharge head of this invention is further characterized by the fact that the movable member mentioned above is shaped like a plate.

The liquid discharge head of this invention is further characterized by the fact that the movable separation membrane is formed of a resin.

The liquid discharge head of this invention is further characterized by being provided with a first common liquid chamber for storing a liquid to be fed to the first flow path and a second common liquid chamber for storing a liquid for to be fed to the second flow path.

The liquid discharge head of this invention is further characterized by the fact that the liquid to be fed to the first flow path and the liquid to be fed to the second flow path are different liquids.

The liquid discharge head of this invention is further characterized by the fact that the liquid to be fed to the second flow path excels the liquid to be fed to the first flow path in at least one of the properties, i.e. lowness of viscosity, bubble generating property, and thermal stability.

Since this invention is constructed as described above, the movable separation membrane disposed on the bubble generating region is expanded by the pressure produced by the generation of bubbles and the movable member disposed on the movable separation membrane is displaced toward the first flow path and the movable separation membrane is expanded by the pressure mentioned above in the direction of the discharge port on the first flow path side. As a result, the liquid is efficiently discharged with high discharging force through the discharge port.

Since the movable separation membrane so elongated returns more quickly to the home position in response to the pressure arising from the contraction of bubbles than the movable member, the pressure is controlled in the direction of action, the speed at which the first flow path is refilled with the discharging liquid is heightened, and the retraction of the meniscus is controlled. Thus, the discharge of the liquid is stably obtained even in the printing performed at a high speed.

Further, since the liquid intrudes itself between the movable member and the movable separation membrane during the extinction of bubbles, the vibration which is generated during the return of the movable member and the movable separation membrane to their home positions is diminished with acceleration by the damping effect of the interposed liquid. When the structure for causing this intrusion of the liquid is disposed on the upstream side, the supply of the liquid is promoted and the refilling property is improved.

BRIEF DESCRIPTION OF THE DRAWINGS

FIG. 13A a diagram illustrating a head provided with a protective membrane and FIG. 13B a head not provided with a protective membrane.

DESCRIPTION OF THE PREFERRED EMBODIMENTS

Figure 1A:
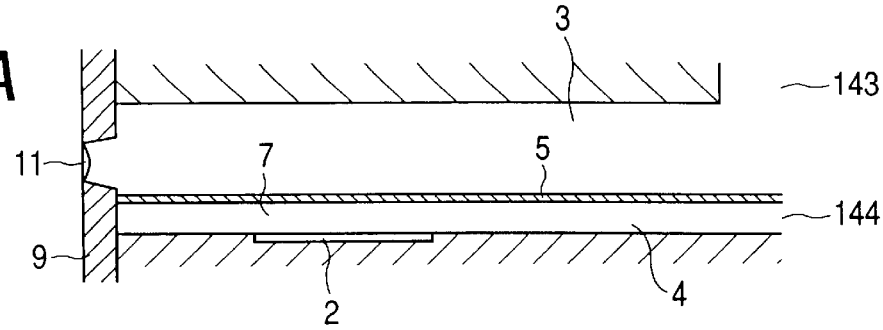
FIGS. 1A, 1B, 1C, 1D, and 1E are cross sections of the directions of flow path depicted to aid in the description of the first example of the method for liquid discharge applicable to the present invention.

The modes of embodying the present invention will be described below with reference to the accompanying drawings.

Examples Applicable to Embodiment of the Invention

Now, two examples which are applicable to the embodiment of the present invention will be described.

FIGS. 1A to 1E through 3A to 3C are diagrams depicted to aid in the description of examples of the method for discharge of liquid which are applicable to the present invention. A discharge port is disposed in the terminal area of a first flow path. On the upstream side of the discharge port (relative to the direction of flow of a discharging liquid in the first flow path), the displacing region of a movable separation membrane capable of being displaced in accordance as the bubbles generated are grown. A second flow path is adapted to store a bubble generating liquid or is filled with the bubble generating liquid (preferably adapted to permit refill or allow the bubble generating liquid to produce a motion) and is furnished with a bubble generating region.

In this example, the bubble generating region is located on the upstream area from the discharge port side relative to the direction of flow of the discharging liquid mentioned above. Moreover, the separation membrane is allowed to have a greater length than an electrothermal conversion element forming the bubble generating region and is consequently endowed with a movable region. A stationary part (not shown) is provided between the upstream side terminal part of the electrothermal conversion element and the common liquid chamber of the first flow path relative to the direction of flow mentioned above, preferably in the upstream side terminal part mentioned above. The range in which the separation membrane is allowed substantial movement, therefore, ought to be understood from FIGS. 1A to 1E through 3A to 3C.

The state of the movable separation membrane depicted in these diagrams represents all the elements such as the elasticity and thickness of the movable separation membrane itself or the factors derivable from other additional structures.

(First example)

FIGS. 1A to 1E comprise cross sections of directions of flow path depicted to aid in the description of the first example of the method of liquid discharge applicable to this invention (wherein the step of displacement contemplated by this invention initiates halfway along the length of the step of liquid discharge).

In this example as illustrated in FIGS. 1A to 1E, a first flow path 3 which directly communicates with a discharge port 11 is filled with the first liquid which is supplied from a common liquid chamber 143 and a second flow path 4 provided with a bubble generating region 7 is filled with a bubble generating liquid which is foamed on exposure to a thermal energy given by a heating element 2. A movable separation membrane 5 for separating the first flow path 3 and the second flow path 4 from each other is disposed between the first flow path 3 and the second flow path 4. The movable separation membrane 5 and an orifice plate 9 are tightly fixed to each other and they do not suffer the liquids in the two flow paths to mingle with each other.

The movable separation membrane 5 generally manifests no directional property while it is being displaced by the bubbles generated in the bubble generating region 7. Rather, there are times when this displacement possibly proceeds toward the common liquid chamber side which enjoys high freedom of displacement.

This example, which has stemmed from the particular notice directed to this motion of the movable separation membrane 5 contemplates providing a device for controlling the direction of the displacement which directly or indirectly acts on the movable separation membrane 5 itself. This device is adapted to cause the displacement (motion, expansion, elongation, etc.) produced in the movable separation membrane 5 by the bubbles to proceed in the direction of the discharge port.

In the initial state illustrated in FIG. 1A, the liquid in the first flow path 3 is drawn in closely to the discharge port 11 by the capillary force. In the present example, the discharge port 11 is located on the downstream side relative to the direction of flow of the liquid in the first flow path 3 with respect to the area in which the heating element 2 is projected to the first flow path 3.

Figure 1B:
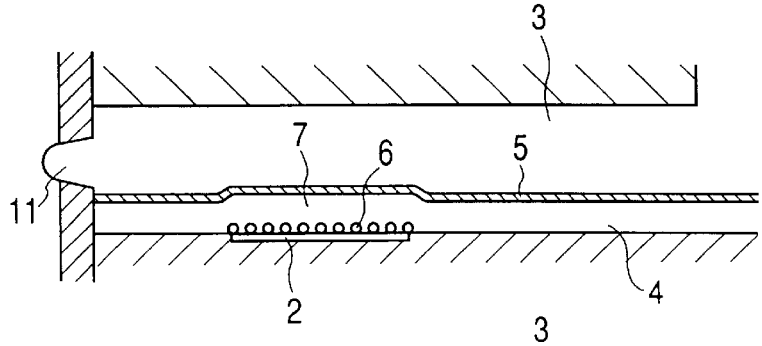

In the existing state, when the thermal energy is applied to the heating element 2 (a heating resistor measuring 40 $\mu$m×105 $\mu$m, in the present mode), the heating element 2 is quickly heated and the surface of the bubble generating region 7 contacting the second liquid causes the second liquid to be bubbled by the heat (FIG. 1B). The bubbles 6 thus generated by the heating are based on such a phenomenon of membrane boiling as is disclosed in U.S. Pat. No. 4,723,129. They are generated as accompanied by extremely high pressure all at once throughout the entire surface of the heating element. The pressure generated at this time propagates in the form of pressure wave through the second liquid in the second flow path 4 and acts on the movable separation membrane 5, with the result that the movable separation membrane 5 will be displaced and the discharge of the first liquid in the first flow path 3 will be started.

Figure 1C:
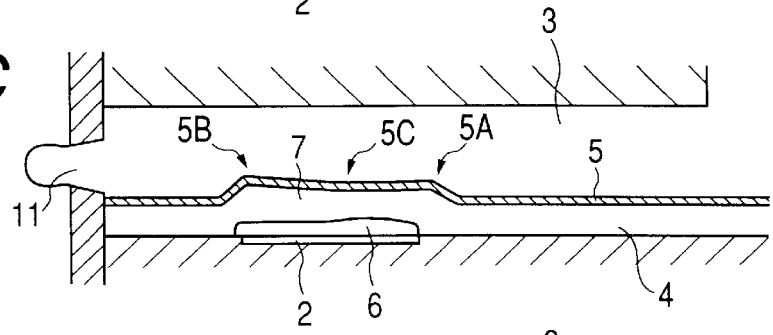

As the bubbles 6 generated on the entire surface of the heating element 2 grow quickly, they assume the shape of a membrane (FIG. 1C). The expansion of the bubbles 6 by the very high pressure in the nascent state further adds to the displacement of the movable separation membrane 5 and, as a result, promotes the discharge of the first liquid in the first flow path 3 through the discharge port 11.

Figure 1D:
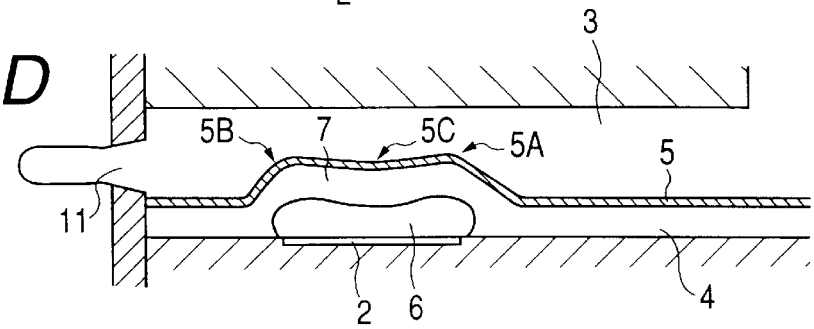

When the growth of the bubbles 6 further continues, the displacement of the movable separation membrane 5 gains in volume (FIG. 1D). Until the state illustrated in FIG. 1D arises, the movable separation membrane 5 continues its elongation such that the displacement of the upstream side part 5A thereof and that of the downstream side part 5B thereof are substantially equal relative to the central part 5C of the region of the movable separation membrane 5 opposite the heating element 2.

Figure 1E:
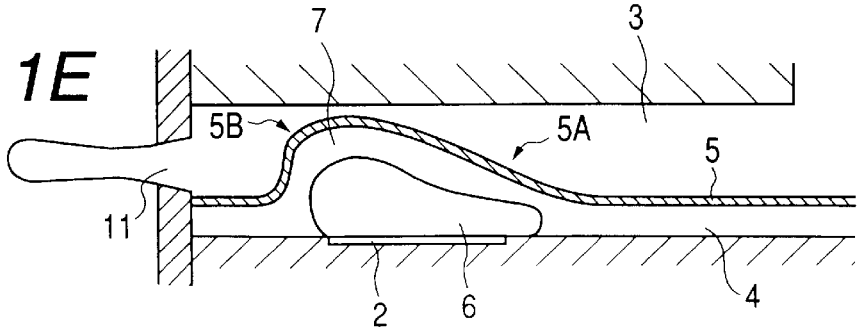

As the bubbles 6 further grow thereafter, the bubbles 6 and the movable separation membrane 5 continuing its displacement are severally displaced in the direction of the discharge output rather more on the upstream side part 5A than on the downstream side part 5B and, as a result, the first liquid in the first flow path 3 is directly moved in the direction of the discharge output 11, (FIG. 1E).

The efficiency of discharge is further improved owing to the incorporation of the step for effecting the displacement of the movable separation membrane 5 in the direction of discharge on the donwstream side so as to allow direct motion of the liquid in the direction of the discharge port as described above. The fact that the motion of the liquid toward the upstream side is decreased relatively brings about a favorable effect on the refill of the liquid (replenished from the upstream side) in the nozzle, specifically the displacing region of the movable separation membrane 5.

When the movable separation membrane 5 itself is displaced in the direction of the discharge port so as to induce a change of state from FIG. 1D to FIG. 1E as illustrated in the respective diagrams FIG. 1D and FIG. 1E, the efficiency of discharge and the efficiency of refill mentioned above can be further improved and, at the same time, the amount of discharge can be exalted by inducing transfer of the portion of the first liquid in the region of projection of the heating element 2 in the first flow path 3.

(Second example)

FIGS. 2A to 2E are cross sections of the direction of flow path depicted to aid in the description of the second example of the method for discharge of liquid which are applicable to the present invention (wherein the step of displacement contemplated by this invention starts from the initial stage).

This example is basically identical in structure to the first example described above. A first flow path 13 which directly communicates with the discharge port 11 is filled with the first liquid supplied from the first common liquid chamber 143 and a second flow path 14 furnished with a bubble generating region 17 is filled with a bubble generating liquid which emits bubbles on exposure to a thermal energy supplied by a heating element 12. A movable separation membrane 15 adapted to separate the first flow path 13 and the second flow path 14 from each other is interposed between the first flow path 13 and the second flow path 14. The movable separation membrane 15 and an orifice plate 19 are tightly fixed to each other and they do not suffer the liquids in the two flow paths to mingle with each other.

Figure 2A:
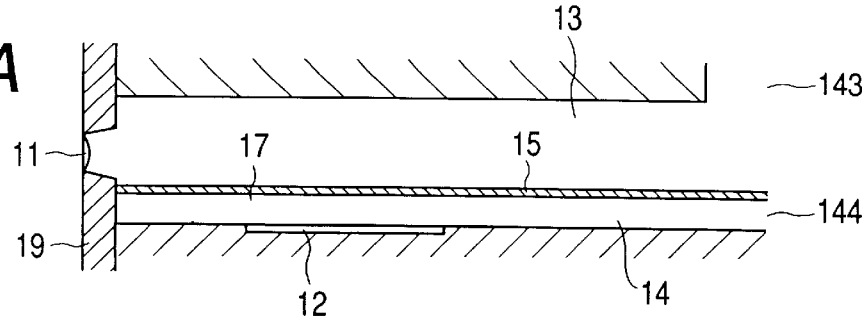
FIGS. 2A, 2B, 2C, 2D, and 2E are cross sections of the directions of flow path depicted to aid in the description of the second example of the method for liquid discharge applicable to the present invention.

In the initial state illustrated in FIG. 2A, similarly in FIG. 1A, the liquid in the first flow path 13 is drawn in closely to the discharge port 11 by the capillary force. In the present example, the discharge port 11 is located on the downstream side relative to the area in which the heating element 12 is projected to the first flow path 13.

Figure 2B:
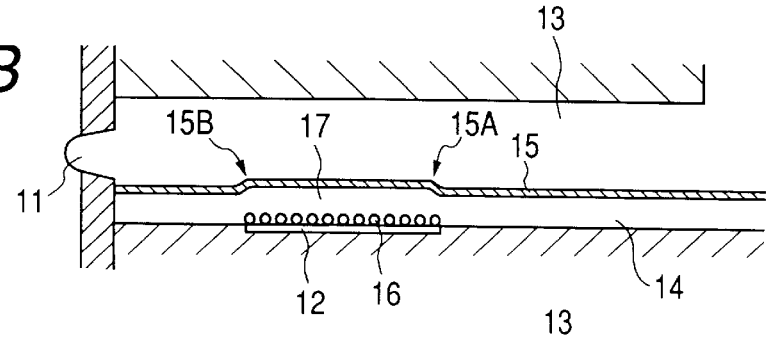

In the existing state, when the thermal energy is given to the heating element 12 (a heating resistor measuring 40 $\mu$m×115 $\mu$m, in the present mode), the heating element 12 is quickly heated and the surface of the bubble generating region 17 contacting the second liquid causes the second liquid to be bubbled by the heat (FIG. 2B). The bubbles 16 thus generated by the heating are based on such a phenomenon of membrane boiling as is disclosed in U.S. Pat. No. 4,723,129. They are generated as accompanied by extremely high pressure all at once throughout the entire surface of the heating element. The pressure generated at this time propagates in the form of pressure wave through the second liquid in the second flow path 14 and acts on the movable separation membrane 15, with the result that the movable separation membrane 15 will be displaced and the discharge of the first liquid in the first flow path 13 will be started.

Figure 2C:
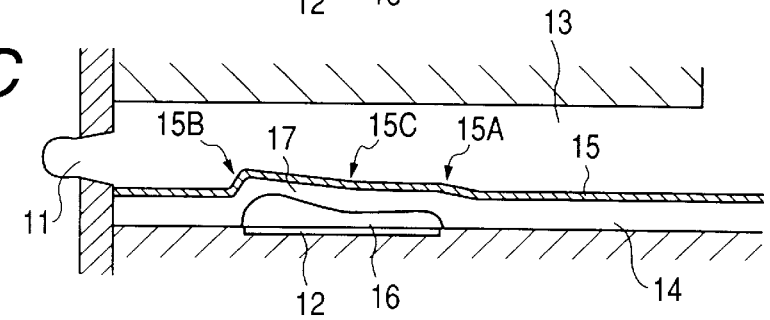
Figure 2D:
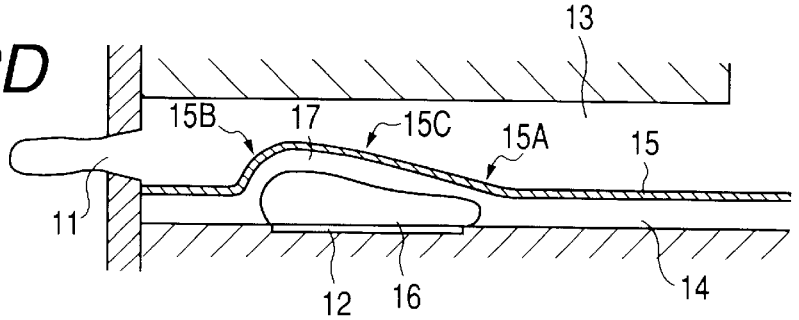

As the bubbles 16 generated on the entire surface of the heating element 12 grow quickly, they eventually assume the shape of a membrane (FIG. 2C). The expansion of the bubbles 16 by the very high pressure in the nascent state further adds to the displacement of the movable separation membrane 15 and, as a result, promotes the discharge of the first liquid in the first flow path 13 through the discharge port 11. At this time, the movable separation membrane 15 has the downstream side part 15B of the movable region thereof displaced rather more than the upstream side part 15A thereof from the initial stage as illustrated in FIG. 2C. The first liquid in the first flow path 13, therefore, is moved to the discharge port 11 with high efficiency from the initial stage.

When the growth of the bubbles 16 further advances thereafter, the displacement of the movable separation membrane 15 is proportionately enlarged (FIG. 2D) because the displacement of the movable separation membrane 15 and the growth of the bubbles are promoted relative to the state illustrated in FIG. 2C. Particularly, since the downstream side part 15B of the movable region is displaced more largely in the direction of the discharge port than the upstream side part 15A and the central part 15C, the first liquid in the first flow path 13 directly moves with acceleration in the direction of the discharge port. Since the displacement of the upstream side part 15A is small throughout the entire process, the motion of the liquid in the upstream direction is diminished.

The method of liquid discharge in this example, therefore, can improve the discharge efficiency, especially the discharge speed and further can favorably stabilize the refill of the liquid in the nozzle and the volume of the discharged liquid drops.

Figure 2E:
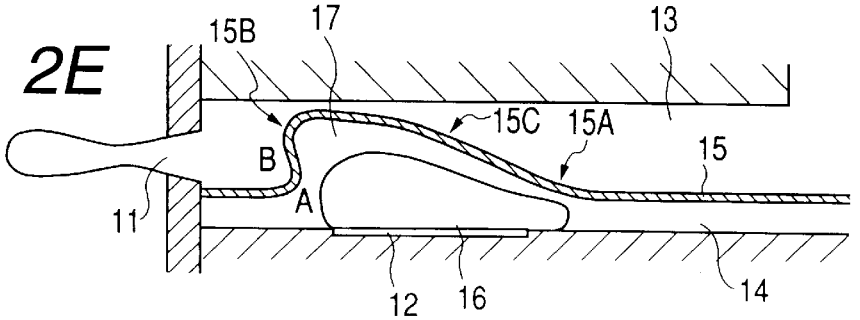

When the growth of the bubbles 16 further continues thereafter, the downstream side part 15B and the central part 15C of the movable separation membrane 15 are further displaced and elongated in the direction of the discharge port to promote the effect mentioned above, namely the improvement of the discharge efficiency and the discharge speed (FIG. 2E). Particularly, since the shape of the movable separation membrane 15 in this case is enlarged not only in the cross section but also in the sizes of displacement and elongation in the direction of width of the flow path, the operating region for moving the first liquid in the first flow path 13 is increased and the discharge efficiency is synergistically improved. Since the shape of the displacement of the movable separation membrane 15 at this time resembles the shape of a human nose, it will be particularly referred to as "nose shape". The nose shape is to be construed as embracing the shape of the latter "S" in which the point B located on the upstream side in the initial state assumes a position on the downstream side from the point A located on the downstream side in the initial state as illustrated in FIG. 2E and the shape in which the points A and B assume equivalent positions as illustrated in FIG. 1E.

Example of Displacement Applicable to Movable Separation Membrane

Figure 3A:
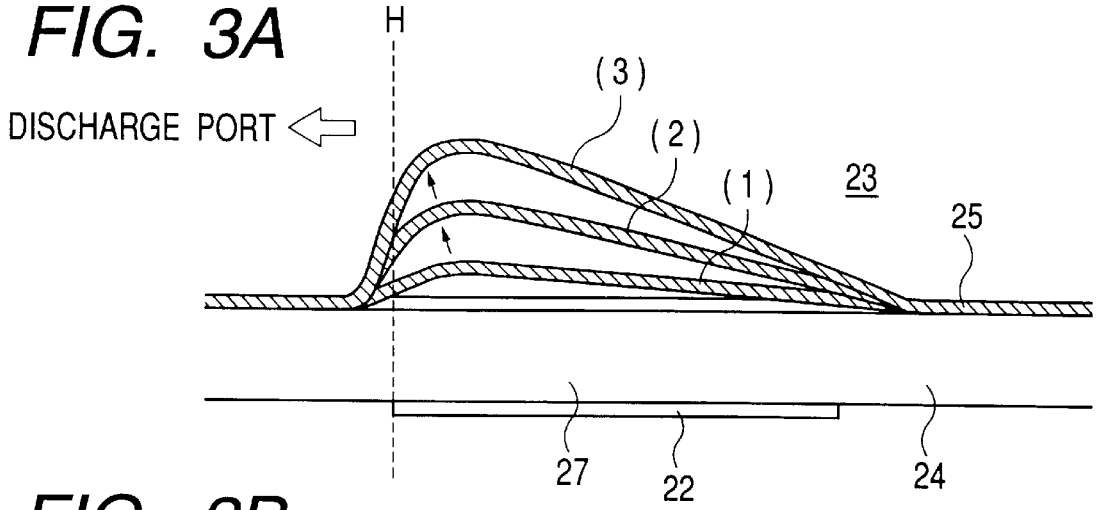
FIGS. 3A, 3B, and 3C are cross sections of the directions of flow path depicted to aid in the description of the step of displacement of a movable separation membrane in the method for liquid discharge applicable to the present invention.
Figure 3B:
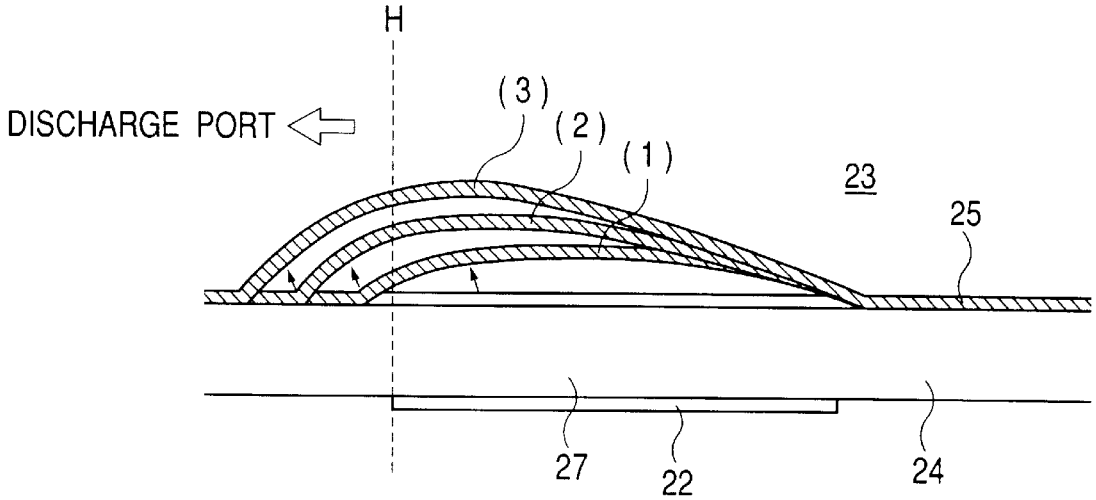
Figure 3C:
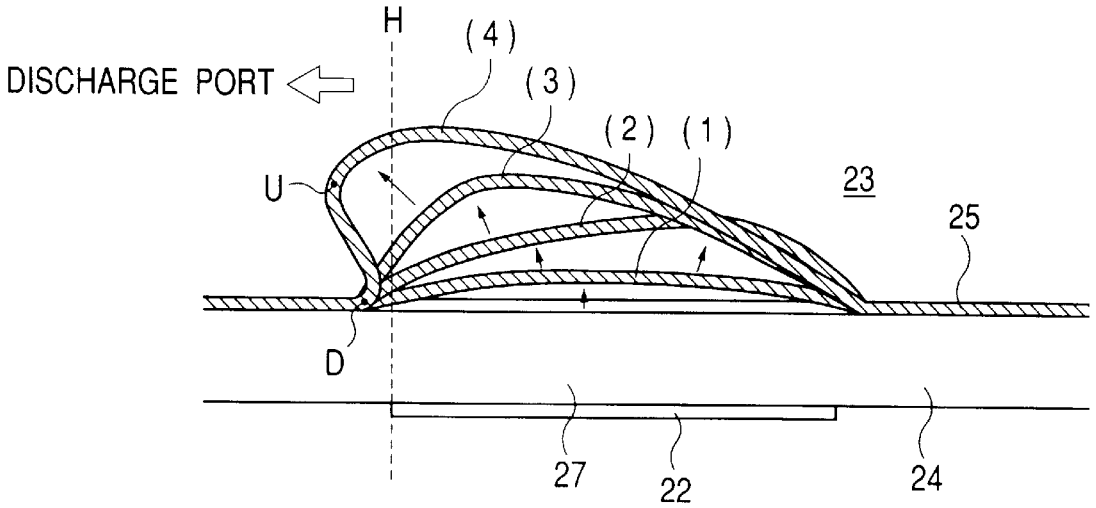

FIGS. 3A to 3C are cross sections of a direction of flow path depicted to aid in the description of the step of displacement of the movable separation membrane in the method of liquid discharge according to this invention.

This example is intended to center its description specifically on the range of motion of the movable separation membrane and the change in displacement thereof, it will omit illustrating the bubbles, first flow path, and discharge port. All the relevant diagrams, as a basic structure, presume that the portion of a second flow path 24 which approximates closely to the region of projection of a heating element 22 constitutes itself a bubble generating region 27 and the second flow path 24 and a first flow path 23 are substantially separated by a movable separation membrane 25 constantly, i.e. from the initial stage through the duration of displacement. A discharge port is disposed on the downstream side and a part for feeding the first liquid on the upstream side with the downstream side terminal part (line H in the diagram) of the heating element 22 as the border line. The terms "upstream side" and "downstream side" as used in the present and following examples are meant in relation to the direction of flow of the liquid in the relevant flow path as viewed from the central part of the movable range of the movable separation membrane.

The method using the structure illustrated in FIG. 3A incorporates therein from the initial stage a step of displacing a movable separation membrane 25 from the initial state sequentially in the order of (1), (2), and (3) and more largely on the downstream side than the upstream side and particularly succeeds in improving the discharge speed because it operates to exalt the discharge efficiency and, at the same time, enable the displacement on the downstream side to impart to the first liquid in the first flow path 23 such a motion as to be forced out in the direction of the discharge port. In the structure of FIG. 3A, the movable range mentioned above is assumed to be substantially fixed.

In the structure illustrated in FIG. 3B, the movable range of the movable separation membrane 25 is shifted or enlarged toward the discharge port in accordance as the movable separation membrane 25 is displaced sequentially in the order of (1), (2), and (3) in the diagram. In the ensuant form, the movable range mentioned above has the upstream side thereof fixed. The discharge efficiency can be further exalted here because the movable separation membrane 25 is displaced more largely on the downstream side than on the upstream side thereof and because the bubbles are grown in the direction of the discharge port.

In the structure illustrated in FIG. 3C, while the movable separation membrane 25 changes from the initial state (1) to the state shown in (2) in the diagram, the upstream side and the downstream side are evenly displaced or the upstream side is displaced rather more largely than the downstream side. As the bubbles further grow from (3) to (4) in the diagram, the downstream side is displaced more largely than the upstream side. As a result, even the first liquid in the upper part of the movable region can be moved in the direction of the discharging port, the discharge efficiency can be improved, and at the same time, the amount of discharge can be increased.

Further, at the step illustrated in (4) of FIG. 3C, since a certain point U of the movable separation membrane 25 is displaced more toward the discharge port than the point D located on the downstream than the point U in the initial state, the discharge efficiency can be further exalted by the part thrust out toward the discharge port in consequence of the expansion. The state consequently assumed will be referred to as "nose shape" as mentioned above.

The methods of liquid discharge which incorporate therein such steps as described above are applicable to the present invention. The components illustrated in FIGS. 3A to 3C do not always function independently of each other. The steps which incorporate such components therein are likewise applicable to this invention. The step which involves the formation of the nose shape is not limited to the structure illustrated in FIG. 3C. It can be incorporated in the structures illustrated in FIGS. 3A and 3B. For the movable separation membrane used in the structure of FIGS. 3A to 3C, the possession of expansibility does not matter and the preparatory impartation of slackness suffices. The thickness of the movable separation membrane appearing in the diagram has no dimensional significance.

The expression "device for controlling direction" as used in the present specification applies to at least one of all the members (means) which bring about the "displacement" specified by the present invention, such as, for example, those stemming from the structure or characteristic of the movable separation membrane itself, those pertaining to the operation or disposition of the bubble generating device with respect to the movable separation membrane, those relating to the fluid resistance offered by the vicinity of the bubble generating region, those acting directly or indirectly on the movable separation membrane, or those effecting control of the displacement or elongation of the movable separation membrane. The embodiments incorporating a plurality (two or more) of such direction controlling devices as mentioned above, therefore, are naturally embraced by the present invention. The examples which will be cited herein below make no definite mention of arbitrary combination of a plurality of direction-controlling devices. This notwithstanding, the present invention does not need to be limited to the following examples.

EXAMPLE 1

Figure 4A:
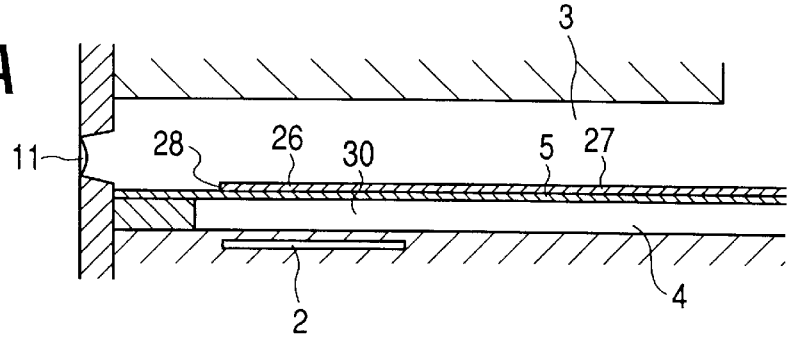
FIGS. 4A, 4B, 4C, 4D, and 4E are model diagrams of cross sections of directions of flow path for illustrating the first example of the liquid discharge head of the present invention.

FIGS. 4A to 4E are model diagrams of the cross section of direction of a flow path for illustrating the first example of the liquid discharge head of the present invention; FIG. 4A representing the state of the liquid discharge head during the absence of liquid discharge and FIGS. 4B, 4C, 4D, and 4E representing the sequential steps of liquid discharge in the order mentioned before the resumption of the state of absence of liquid discharge of FIG. 4A.

The liquid discharge head of this invention comprises a movable separation membrane 5 substantially separating a first flow path 3 communicating with a discharge port 11 for discharging a liquid and a second flow path 4 furnished with a bubble generating region 30 for generating bubbles 40, a heating element 2 for causing generation of the bubbles 40 in the bubble generating region 30, and a movable member 26 opposed across the movable separation membrane 5 to the bubble generating region 30 and furnished with a free terminal 28 in the direction of the discharge port, with the movable separation membrane 5 and the movable member 26 so adapted to be kept apart during the contraction of the bubbles 40.

In the present example, the movable member is opposed to the heating element 26 and the free terminal 28 is disposed directly above the discharge port side terminal of the heating element 2 across the movable separation membrane 5.

Figure 4B:
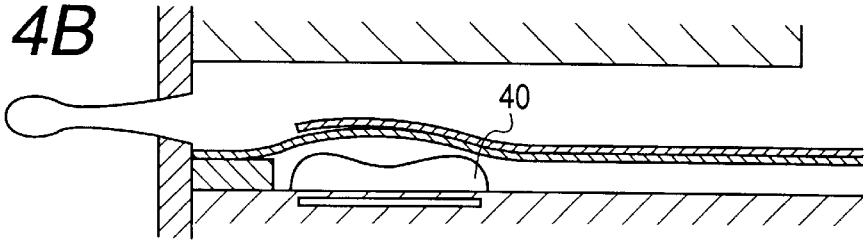

With reference to FIG. 4B, when the heating element 2 incites the bubble generating region 30 to generate the bubbles 40, the bubbles 40 expand the movable separation membrane 5 and displace the free terminal 28 largely because the movable member 26 has a fulcrum 27 thereof on the upstream side and the free terminal 26 thereof on the downstream side. The discharge efficiency is improved because the movable separation membrane 5 is largely expanded toward the discharge port as controlled by the shape of displacement of the movable member 26.

Figure 4C:
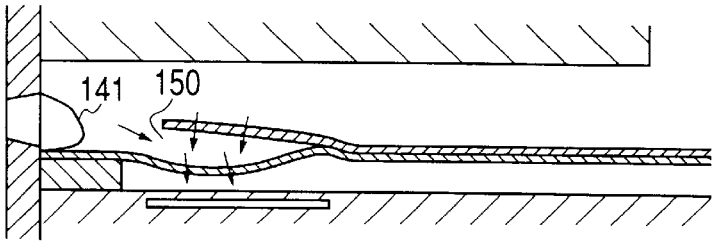

FIG. 4C illustrates the process of the contraction of the bubbles 40 until extinction. The pressure arising from the extinction of bubbles immediately pulls the movable separation membrane 5 in the direction of the extinction of the bubbles 40. At this time, since the movable member 26 has strong rigidity as compared with the movable separation membrane 5, the movable member 26 displaces slower than the movable separation membrane 5 and the movable separation membrane 5 and the movable member 26 are separated from each other and a liquid 150 is interposed between the movable separation membrane 5 and the movable member 26. This liquid 150 drags in a meniscus 141 largely because the greater part thereof is supplied from the free terminal side of the movable member 26. Particularly, the meniscus of the region close to the heating element 2 which needs the supply of the liquid in a large volume is dragged in conspicuously.

Figure 4D:
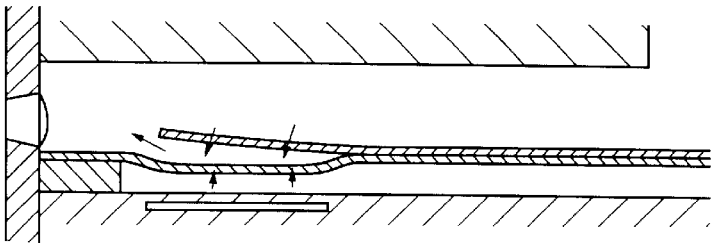
Figure 4E:
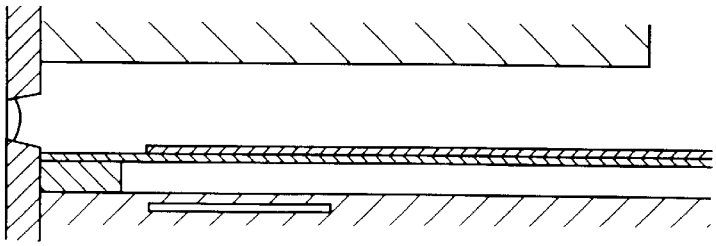

FIG. 4D illustrates the process in which the movable separation membrane 5 displaced by the pressure of extinction of bubbles more toward the heating element side than the home position is returned to the home position. While the movable separation membrane 5 displaced toward the heating element side returns to the home position, it has the possibility of inducing the phenomenon of a damped oscillation when it abounds in elasticity. This oscillation has the possibility of shaking the meniscus 141 and rendering the subsequent state of discharge unstable. This invention enables the spring oscillation produced by the movable separation membrane 5 to be damped more quickly by causing the liquid 150 intervening between the movable separation membrane 5 and the movable member 26 to function as a damper or cushion. In the present example, since the free terminal 28 of the movable member 26 is disposed directly above the discharge port side terminal of the heating element 2 across the movable separation membrane 5, the liquid 150 functioning as the damper and covering the greater part of the movable separation membrane 5 manifests a conspicuous effect of curbing the spring oscillation. As a result, the shift of the state of FIG. 4D through that of FIG. 4E to the initial state of FIG. 4A is allowed to proceed quickly and, at the same time, the unstable motion of discharge due to the spring oscillation of the movable separation membrane 5 can be precluded.

EXAMPLE 2

FIGS. 5A to 5E illustrate a modification of the first example effected by having the free terminal 28 of the movable member 26 disposed closely to the discharge port.

Figure 5A:
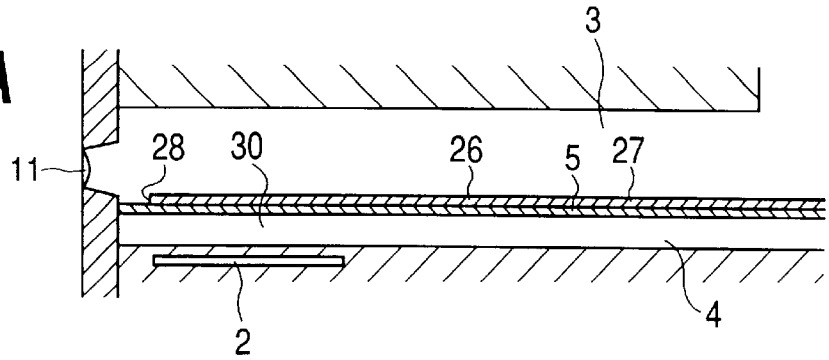
FIGS. 5A, 5B, 5C, 5D, and 5E are model diagrams of cross sections of directions of flow path for illustrating the second example of the liquid discharge head of the present invention.
Figure 5B:
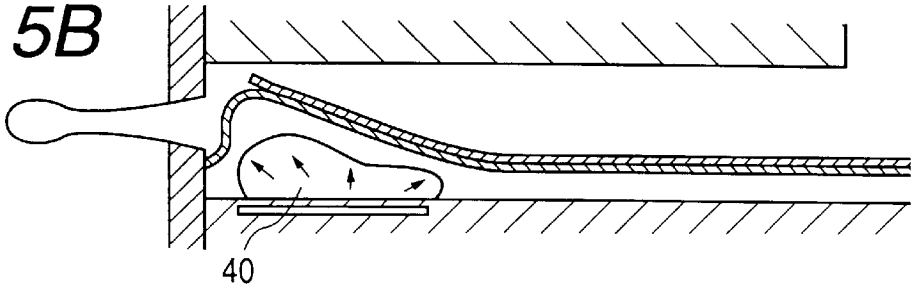

With reference to FIG. 5B, when the heating element 2 causes generation of the bubbles 40 in the bubble generating region 30, the bubbles 40 expand the movable separation membrane 5. Since the movable member 26 has the fulcrum 27 thereof disposed on the upstream side and the free terminal 28 thereof disposed closely to the discharge port 11 on the downstream side, the free terminal 28 can be largely displaced. The discharge efficiency of the liquid discharge head is exalted because the movable separation membrane 5 is likewise expanded largely toward the discharge port as controlled by the shape of displacement of the movable member 26.

Figure 5C:
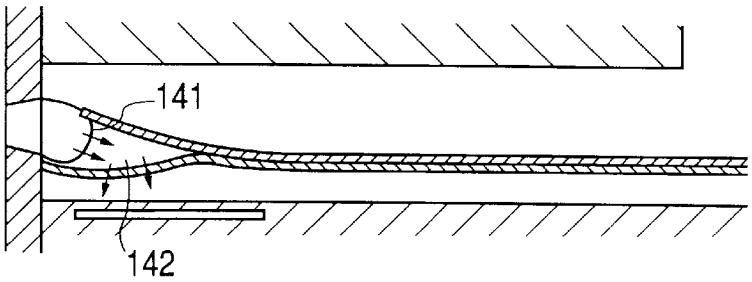

FIG. 5C illustrates the process of extinction of the bubbles 40 by shrinkage. Owing to the defoaming pressure, the movable separation membrane 5 is immediately pulled in the direction of causing extinction of the bubbles 40 and the movable separation membrane 5 and the movable member 26 are separated from each other and the liquid is interposed between the movable separation membrane 5 and the movable member 26. This liquid drags in a meniscus 141 largely because the greater part thereof is supplied from the free terminal side of the movable member 26. The part of the meniscus 141 in the region close to the heating element 2 which needs the supply of the liquid in a large volume is dragged in conspicuously. Particularly in the present example, since the meniscus 141 contacts the vicinity of the free terminal 28 of the movable member 26, the movable member 26 divides the meniscus into the upper and the lower side, entraps the liquid between the movable separation membrane 5 and the movable member 26, and enables a liquid 142 to persist therebetween in an independent state.

Figure 5D:
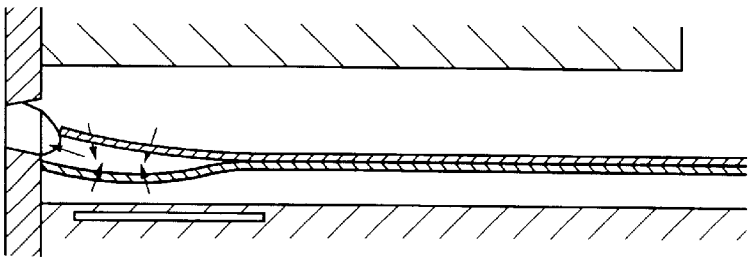
Figure 5E:
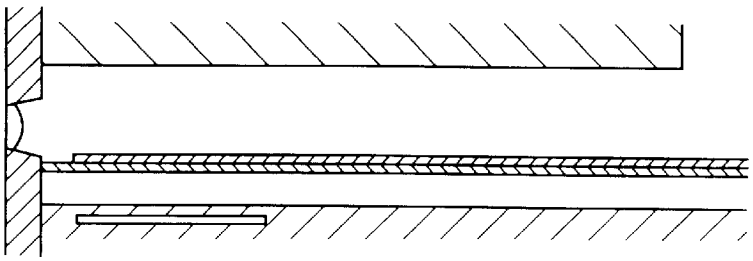

FIG. 5D illustrates the process in which the movable separation membrane 5 displaced toward the heating element side from the home position is returned to the home position by the defoaming pressure. The return to the home position of the movable separation membrane 5 which has been displaced toward the heating element side possibly gives rise to a damped oscillation when the movable separation membrane 5 abounds in elasticity. At times, this oscillation shakes the meniscus 141 and renders unstable the subsequent state of discharge. In the present example, the oscillation generated in the movable separation membrane 5 is damped with very high efficiency because the liquid 142 interposed between the movable separation membrane 5 and the movable member 26 forms a meniscus, functions as a damper or cushion, and precludes the movable separation membrane 5 from emitting oscillations and other similar fine motions. In the present example, since the free terminal 28 of the movable member 26 is disposed directly above the discharge port side terminal of the heating element 2 across the movable separation membrane 5, the liquid 142 which functions as a damper or cushion covers the greater part of the movable separation membrane 5 and, therefore, manifests a prominent effect in curbing the spring oscillation. As a result, the shift of the state of FIG. 5D through that of FIG. 5E to the initial state of FIG. 5A is allowed to proceed quickly and, at the same time, the unstable motion of discharge due to the spring oscillation of the movable separation membrane 5 can be precluded.

EXAMPLE 3

FIGS. 6A to 6E illustrate a modification of the first example effected by having the free terminal 28 of the movable member 26 disposed on the upstream side from the discharge port side terminal of the heating element 2.

Figure 6A:
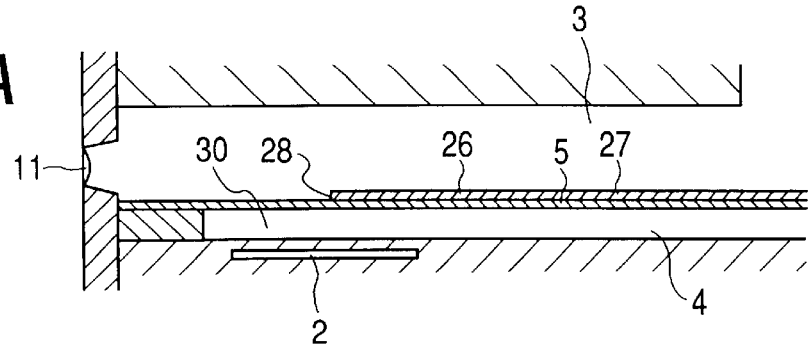
FIGS. 6A, 6B, 6C, 6D, and 6E are model diagrams of cross sections of directions of flow path for illustrating the third example of the liquid discharge head of the present invention.
Figure 6B:
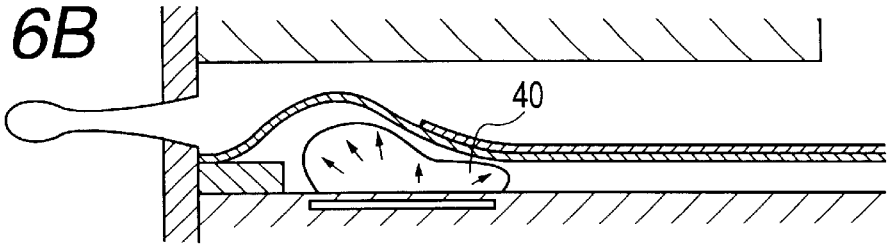

FIG. 6B illustrates the state assumed during the generation of bubbles. The bubbles 40 largely grow in the direction of the discharge port from the center of the area of the heating element 2 from which the movable member 26 is absent. As a result, the discharge efficiency is exalted because the movable separation membrane 5 is also allowed to expand toward the discharge port.

Figure 6C:
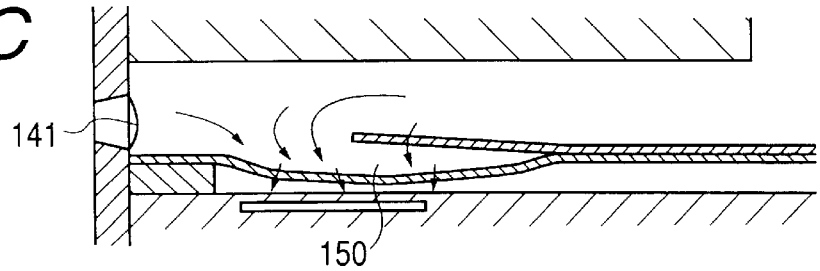

FIG. 6C illustrates the process of extinction of the bubbles 40 by shrinkage. Owing to the defoaming pressure, the movable separation membrane 5 is immediately pulled in the direction of causing extinction of the bubbles 40 and the movable separation membrane 5 and the movable member 26 are separated from each other and the liquid 150 is caused to intrude therebetween. Indeed, the greater part of this liquid 150 is supplied from the free terminal side of the movable member 26. Since the free terminal 28 of the movable member 26 falls on the upstream side from the discharge port side terminal of the region of the movable separation membrane 5 opposed to the heating element 2 in the present example, the supply of the liquid 150 for the downward displacement of the movable separation membrane 5 is amply effected from the upstream side and the retraction of the meniscus 141 is consequently decreased. The refill property, therefore, is exalted more in this example than the preceding example.

Figure 6D:
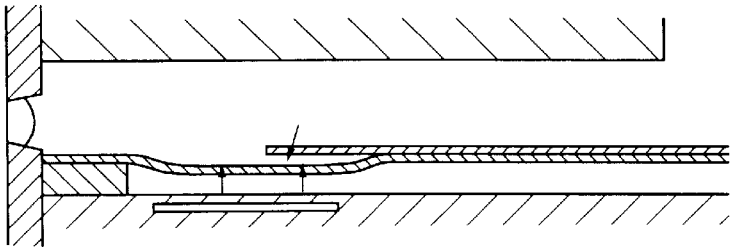
Figure 6E:
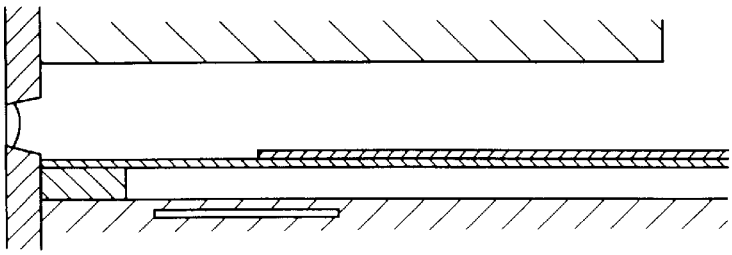

FIG. 6D illustrates the process in which the movable separation membrane 5 displaced toward the heating element side from the home position is returned to the home position by the defoaming pressure. The return to the home position of the movable separation membrane 5 which has been displaced toward the heating element side possibly gives rise to a damped oscillation when the movable separation membrane 5 abounds in elasticity. In the present example, however, the spring oscillation of the movable separation membrane 5 can be damped quickly and the shift of the state of FIG. 6D through that of FIG. 6E to the initial state of FIG. 6A can be effected because the liquid 150 intervenes between the movable separation membrane 5 and the movable member 26 and the liquid 150 is enabled to function as a damper or cushion. Thus, the unstable motion of discharge can be prevented.

EXAMPLE 4

FIGS. 7A to 7E illustrate a modification of the first example effected by having a liquid intrusion promoting structure formed on the fulcrum side of the movable member 26.

Figure 7A:
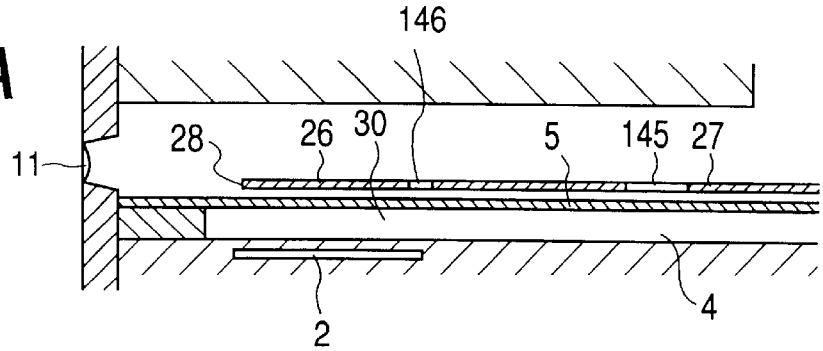
FIGS. 7A, 7B, 7C, 7D, and 7E are model diagrams of cross sections of directions of flow path for illustrating the fourth example of the liquid discharge head of the present invention.
Figure 7B:
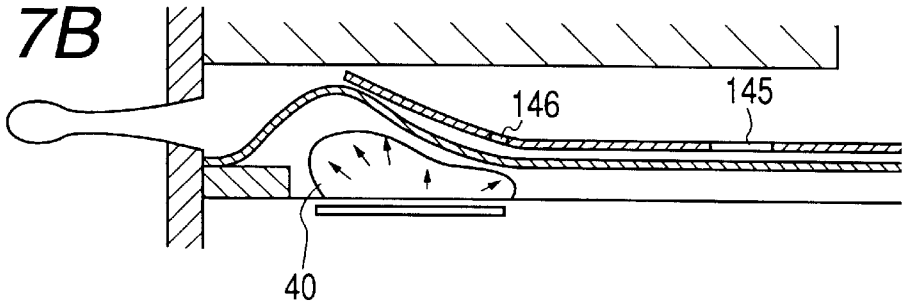

With reference to FIG. 7B, when the heating element 2 causes generation of the bubbles 40 in the bubble generating region 30, the bubbles 40 expand the movable separation membrane 5. Since the movable member 26 has the fulcrum 27 thereof disposed on the upstream side and free terminal 28 thereof on the downstream side, the free terminal 28 on being displaced largely causes the movable separation membrane 5 to be displaced in conformity with the displaced shape of the movable member 26 and expanded largely toward the discharge port. The discharge efficiency, therefore, is exalted because the bubbles 40 are largely guided toward the discharge port.

Figure 7C:
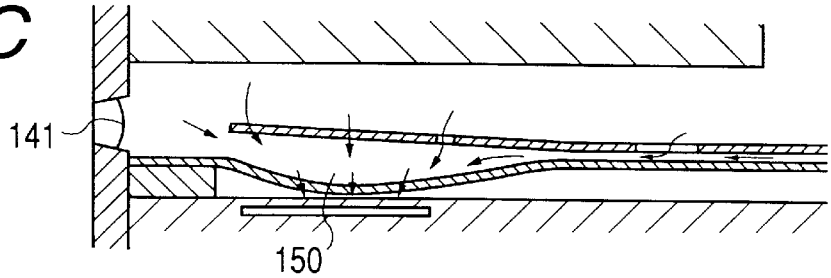

FIG. 7C illustrates the process of extinction of the bubbles 40 by shrinkage. Owing to the defoaming pressure, the movable separation membrane 5 is immediately pulled in the direction of causing extinction of the bubbles 40 and the movable separation membrane 5 and the movable member 26 are separated from each other and the liquid 150 is interposed between the movable separation membrane 5 and the movable member 26. This liquid 150 is supplied also from feed openings 145, and 146, which form the liquid intrusion promoting structure intended to be provided on the fulcrum side of the movable member 26 and the supply of the liquid from the free terminal side of the movable member 26 is curbed by the presence of the movable member 26. As a result, the refill property is exalted because the retraction of the meniscus is decreased.

Figure 7D:
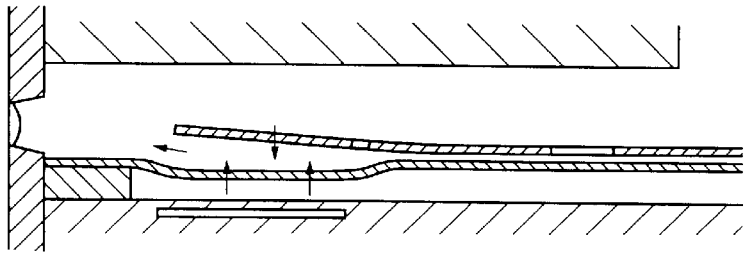
Figure 7E:
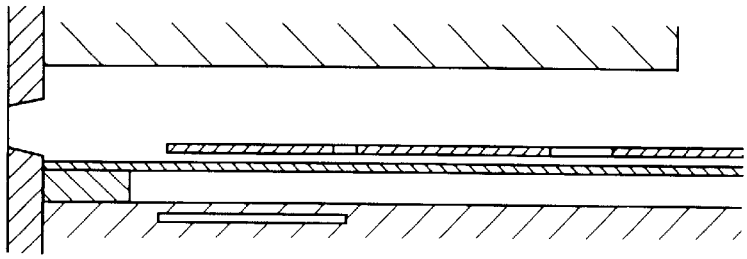

FIG. 7D illustrates the process in which the movable separation membrane 5 displaced toward the heating element side from the home position is returned to the home position by the defoaming pressure. The return to the home position of the movable separation membrane 5 which has been displaced toward the heating element side inevitably suffers occurrence of a damped oscillation when the movable separation membrane 5 abounds in elasticity. In the present example, however, the spring oscillation of the movable separation membrane 5 can be damped quickly because the liquid 150 which intervenes between the movable separation membrane 5 and the movable member 26 is enabled to function as a damper or cushion. As a result, the shift of the state of FIG. 7D through that of FIG. 7E to the initial state of FIG. 7A can be effected and, at the same time, the unstable motion of discharge due to the spring oscillation of the movable separation membrane 5 can be prevented. The printing of an image of high quality at a high speed, therefore, can be realized.

The present example, as described above, can exalt the effect of curbing the retraction of the meniscus 141 improving the refill property, and damping the oscillation of the movable separation membrane.

EXAMPLE 5

FIGS. 8A to 8E illustrate a modification of the second example effected by having a liquid intrusion promoting structure formed on the fulcrum side of the movable member 26.

Figure 8A:
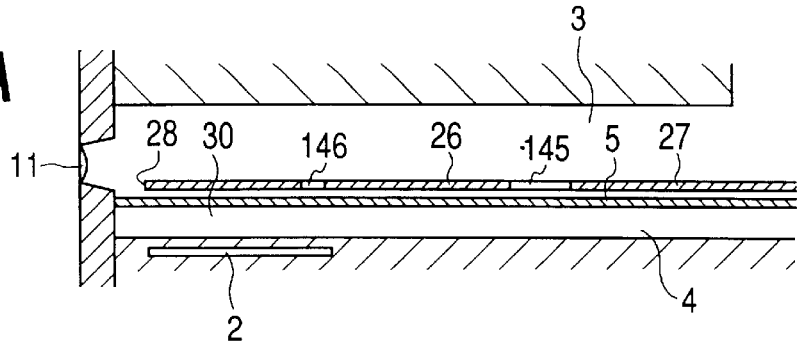
FIGS. 8A, 8B, 8C, 8D, and 8E are model diagrams of cross sections of directions of flow path for illustrating the fifth example of the liquid discharge head of the present invention.
Figure 8B:
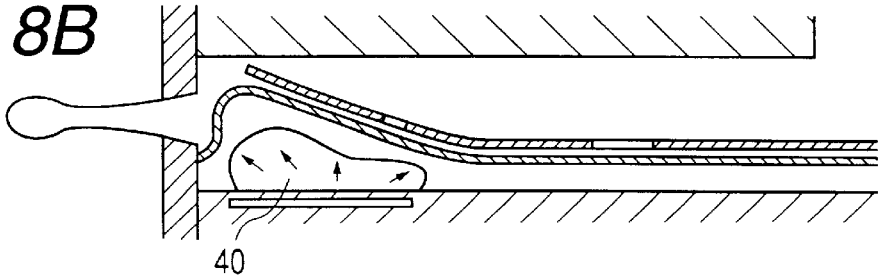

With reference to FIG. 8B, when the heating element 2 incites the bubble generating region 30 to generate the bubbles 40, the bubbles expand the movable separation membrane 5. The free terminal 28 of the movable member 26 can be largely displaced, however, because the movable member 26 has the fulcrum 27 thereof disposed on the upstream side and the free terminal 28 thereof disposed on the downstream side as approximated closely to the discharge port. The discharge efficiency is exalted because the movable separation membrane 5 is largely expanded toward the discharge port as controlled by the shape of displacement of the movable member 26.

Figure 8C:
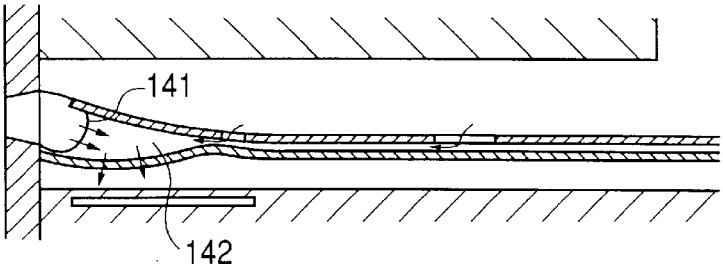

FIG. 8C illustrates the process of extinction of the bubbles 40 by shrinkage. Owing to the defoaming pressure, the movable separation membrane 5 is immediately pulled in the direction of causing extinction of the bubbles 40 and the movable separation membrane 5 and the movable member 26 are separated from each other and the liquid is interposed between the movable separation membrane 5 and the movable member 26. The meniscus 141 is pulled in because the greater part of this liquid is supplied from the free terminal side of the movable member 26. Particularly in the case of this example, since the meniscus 141 contacts the vicinity of the free terminal 28 of the movable member 26, the movable member 26 divides the meniscus 141 into the upper and the lower side, entraps the liquid between the movable separation membrane 5 and the movable member 26, and enables the liquid 142 to persist therebetween in an independent state.

In the case of this example, the retraction of the meniscus 141 is decreased and the refill property is improved because the supply of liquid is effected also from the feed openings 145 and 146 which form the liquid intrusion promoting structure to be disposed on the fulcrum side of the movable member 16 and the supply of the liquid from the free terminal side of the movable member 26 is repressed by the presence of the movable member 26.

Figure 8D:
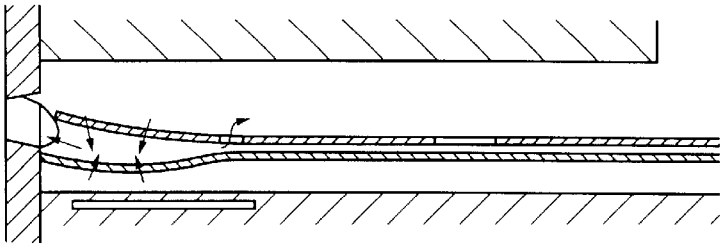
Figure 8E:
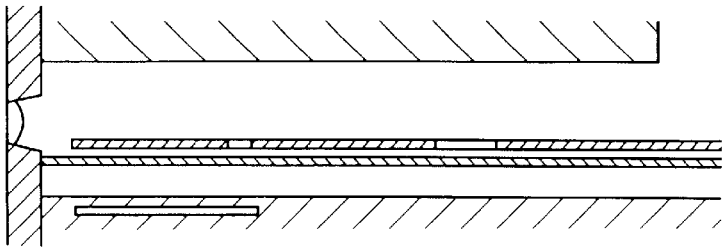

FIG. 8D illustrates the process in which the movable separation membrane 5 displaced toward the heating element side from the home position is returned to the home position by the defoaming pressure. The return to the home position of the movable separation membrane 5 which has been displaced toward the heating element side possibly gives rise to a damped oscillation when the movable separation membrane 5 abounds in elasticity. At times, this oscillation shakes the meniscus 141 and renders the subsequent state of discharge unstable. In the present example, the oscillation generated in the movable separation membrane 5 is damped with very high efficiency because the liquid 142 interposed between the movable separation membrane 5 and the movable member 26 forms a meniscus, functions as a damper or cushion, and precludes the movable separation membrane 5 from emitting oscillations and other similar fine motions. In the present example, since the free terminal 28 of the movable member 26 is disposed directly above the discharge port side terminal of the heating element 2 across the movable separation membrane 5, the liquid 142 which functions as a damper or cushion covers the greater part of the movable separation membrane 5 and, therefore, manifests a prominent effect in curbing the spring oscillation. As a result, the shift of the state of FIG. 8D through that of FIG. 8E to the initial state of FIG. 8A is allowed to proceed quickly and, at the same time, the unstable motion of discharge due to the spring oscillation of the movable separation membrane 5 can be precluded.

EXAMPLE 6

FIGS. 9A to 9E illustrate a modification of the first example effected by having a tight adhesion preventing structure serving to preclude the movable member from tight adhesion with the movable separation membrane 5 disposed in the region of contact between the movable member 26 and the movable separation membrane 5. This structure concurrently fulfills the function as a liquid intrusion promoting structure.

Figure 9A:
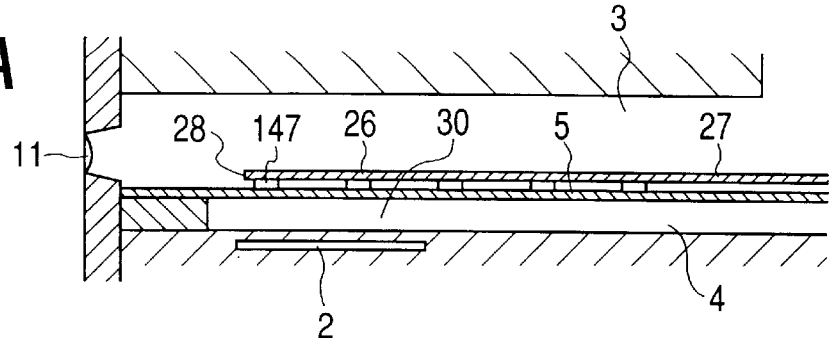
FIGS. 9A, 9B, 9C, 9D, and 9E are model diagrams of cross sections of directions of flow path for illustrating the sixth example of the liquid discharge head of the present invention.
Figure 9B:
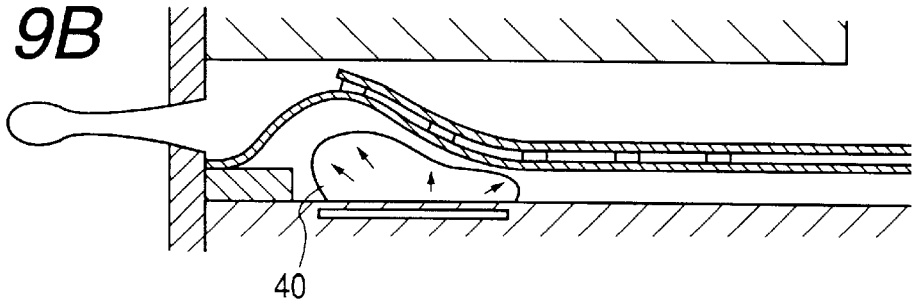

With reference to FIG. 9B, when the heating element 2 causes generation of the bubbles 40 in the bubble generating region 30, the bubbles 40 expand the movable separation membrane 5. Since the movable member 26 has the fulcrum 27 thereof disposed on the upstream side and free terminal 28 thereof on the downstream side, the free terminal 28 on being displaced largely causes the movable separation membrane 5 to be displaced in conformity with the displaced shape of the movable member 26 and expanded largely toward the discharge port. The discharge efficiency, therefore, is exalted because the bubbles 40 are largely guided toward the discharge port.

Figure 9C:
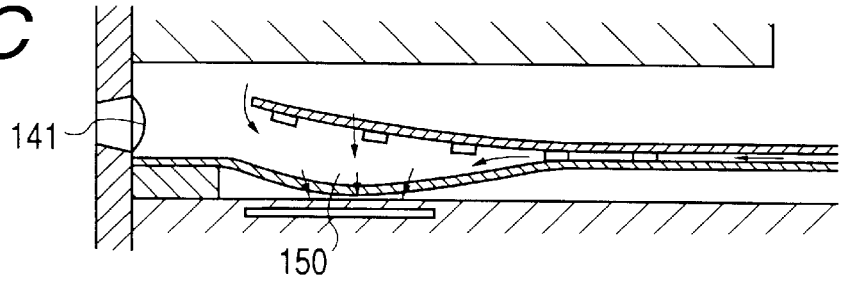

FIG. 9C illustrates the process of extinction of the bubbles 40 by shrinkage. Owing to the defoaming pressure, the movable separation membrane 5 is immediately pulled in the direction of causing extinction of the bubbles 40. At this time, since a plurality of convex points 147 forming a structure for preventing tight adhesion with the movable separation membrane 5 are disposed in the region of the movable member 26 contacting the movable separation membrane 5, the separation of the movable separation membrane 26 from the movable member is easily attained and the liquid 150 is interposed between the movable separation membrane 5 and the movable member 26. As a result, the durability of the movable separation membrane 5 is improved because the motion of displacement produced by the movable separation membrane 5 in consequence of the change in pressure during the extinction of bubbles is no longer restrained.

Figure 9D:
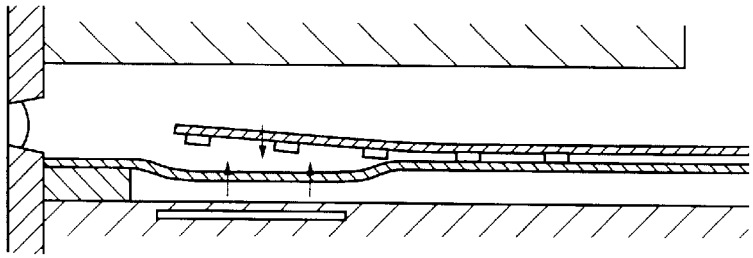
Figure 9E:
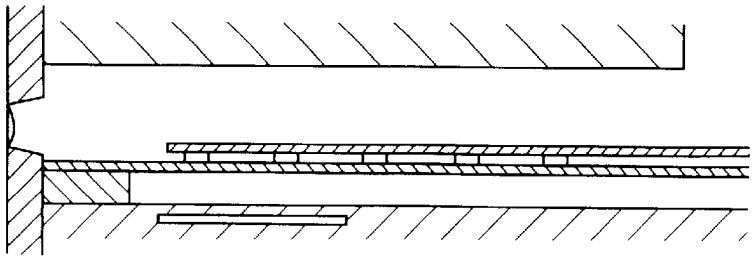

FIG. 9D illustrates the process in which the movable separation membrane 5 displaced toward the heating element side from the home position is returned to the home position by the defoaming pressure. The return to the home position of the movable separation membrane 5 which has been displaced toward the heating element side inevitably suffers occurrence of a damped oscillation when the movable separation membrane 5 abounds in elasticity. In the present example, however, the spring oscillation of the movable separation membrane 5 can be damped quickly because the liquid 150 which intervenes between the movable separation membrane 5 and the movable member 26 is enabled to function as a damper or cushion. As a result, the shift of the state of FIG. 9D through that of FIG. 9E to the initial state of FIG. 9A can be effected. Further, the unstable motion of discharge can be precluded by repressing the spring oscillation of the movable separation membrane. The printing of an image of high quality at a high speed, therefore, can be realized.

EXAMPLE 7

Figure 10:
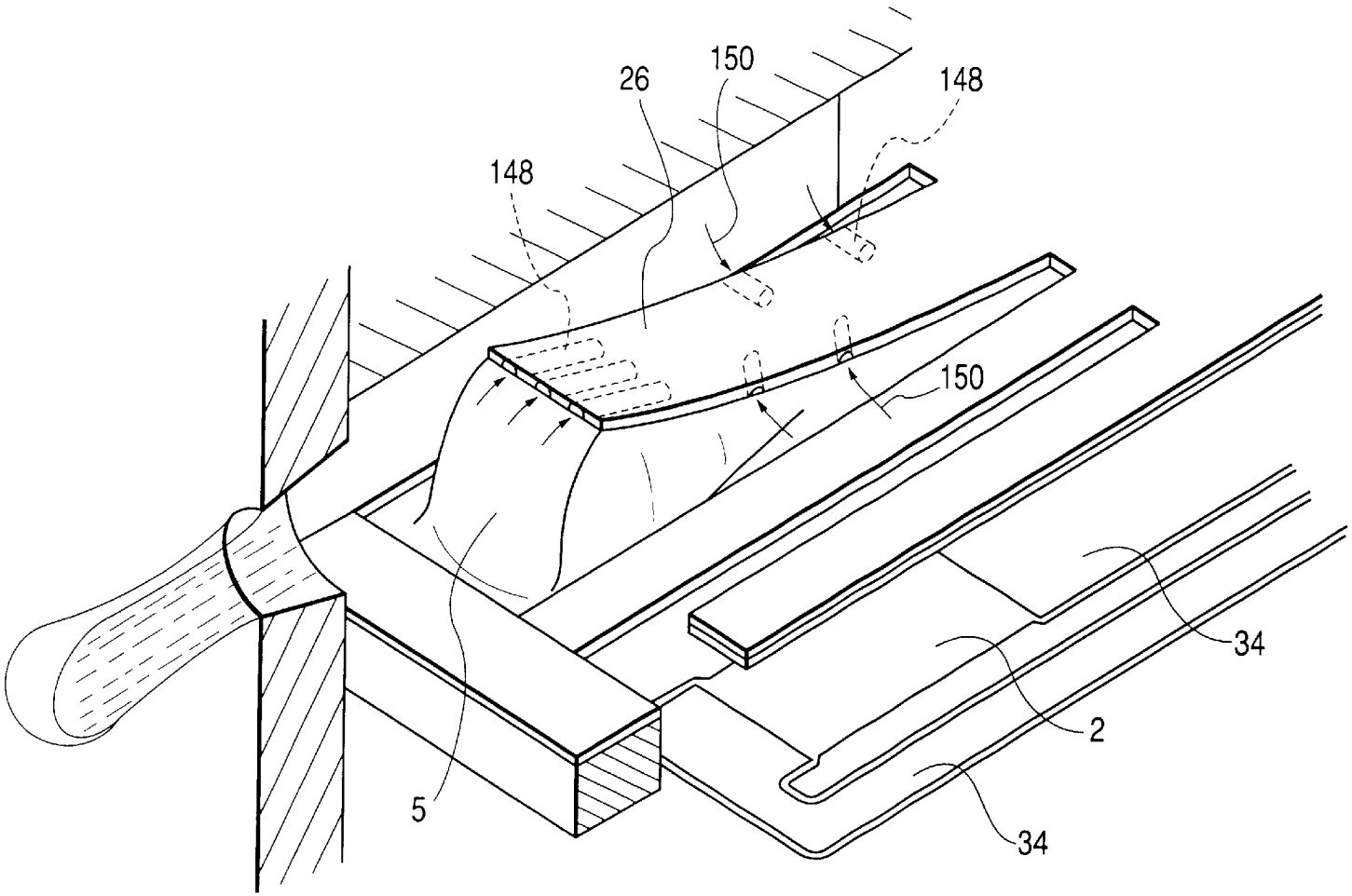
FIG. 10 is a model diagram of a cross section of a direction of flow path illustrating the seventh example of the liquid discharge head of the present invention.

The example depicted in FIG. 10 is a modification of the sixth example effected by having a plurality of liquid inflow grooves 148 disposed as a tight adhesion preventing structure on the movable separation membrane side of the movable member 26. The plurality of liquid inflow grooves 148 are formed as extended inward from the leading end and the lateral ends of the movable member 26. Owing to the structure of this sort, the movable separation membrane 5 is easily separated from the movable member 26 and the liquid 150 is interposed between the movable separation membrane 5 and the movable member 26. The other aspects of the structure and operation are similar to those of the sixth example, they will be omitted from the following description. To the heating element 2 as an electric resistor which is opposed to the movable member 26 mentioned above, the electric current is supplied from a wiring 34.

The liquid discharge head of the present example has a shape which is effective when the movable separation membrane 5 has a soft surface and the ribs and the embossed contours of the movable member 26 are completely buried in the movable separation membrane 5.

EXAMPLE 8

The example depicted in FIGS. 11A to 11E has the movable member 26 retained in a tilted state in the first flow path 3 unlike examples 1 through 7 which have the movable member 26 largely displaced in consequence of the expansion of the movable separation membrane 5.

Figure 11A:
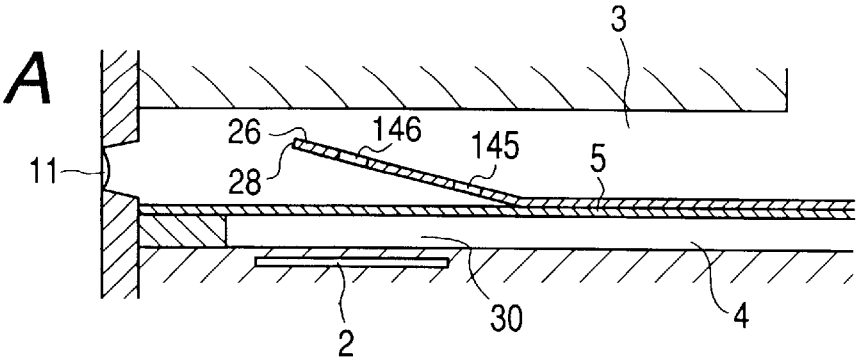
FIGS. 11A, 11B, 11C, 11D and 11E are model diagrams of cross sections of directions of flow path for illustrating the eighth example of the liquid discharge head of the present invention.
Figure 11B:
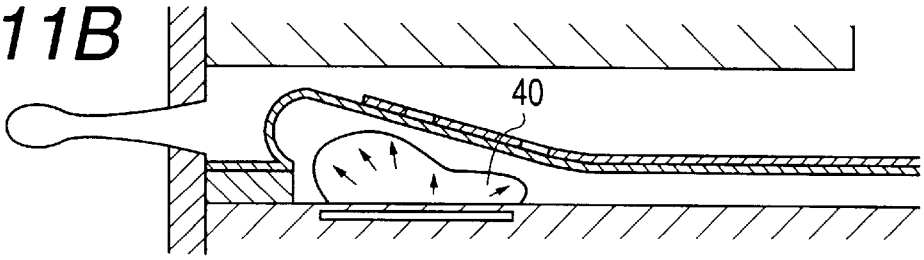

With reference to FIG. 11B, when the heating element 2 incites the bubble generating region 30 to generate the bubbles 40, the bubbles 40 expand the movable separation membrane 5. Since the free terminal 28 of the movable member 26 is retained as tilted from the fulcrum 27 into the first flow path 3, the movable separation membrane 5 is displaced so as to conform to the inclined shape of the movable member 26 and expanded largely toward the outlet port. As a result, the discharge efficiency is exalted because the bubbles 40 are largely guided toward the discharge port.

Figure 11C:
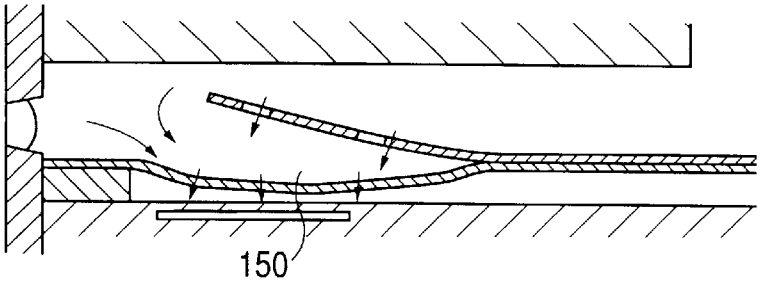

FIG. 11C illustrates the process of extinction of the bubbles 40 by shrinkage. Owing to the defoaming pressure, the movable separation membrane 5 is immediately pulled in the direction of causing extinction of the bubbles 40, the movable separation membrane 5 and the movable member 26 are separated from each other, and the liquid is interposed between the movable separation membrane 5 and the movable member 26. While the greater part of this liquid is supplied from the free terminal side of the movable member 26, the supply of liquid is also effected from the feed openings 145 and 146 which are disposed on the fulcrum side of the movable member 26. As a result, the durability of the movable separation membrane 5 is improved because the movable separation membrane 5 ceases to curb the motion of displacement in consequence of the change of pressure during the extinction of the bubbles.

Figure 11D:
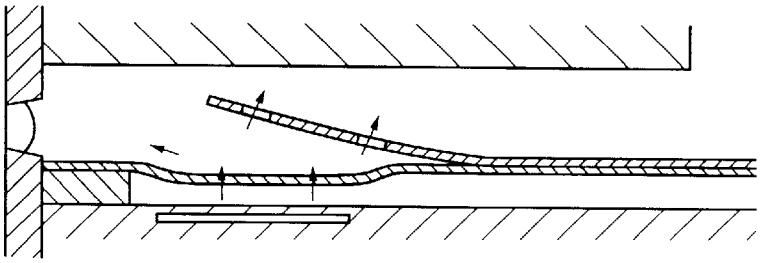
Figure 11E:
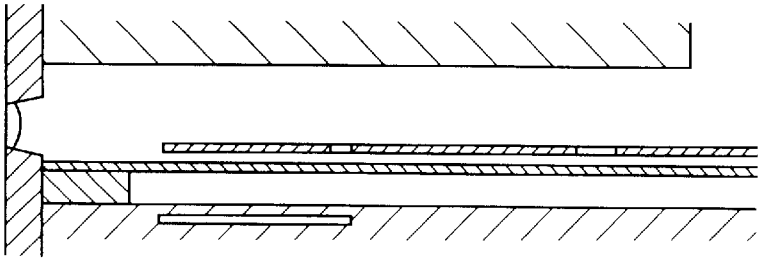

With reference to FIG. 11D, the return to the home position of the movable separation membrane 5 which has been displaced toward the heating element inevitable gives rise to a damped oscillation. According to this invention, however, the spring oscillation of the movable separation membrane 5 can be damped quickly because the liquid 150 which intervenes between the movable separation membrane 5 and the movable member 26 is enabled to function as a damper or cushion. As a result, the shift of the state of FIG. 11D through that of FIG. 11E to the initial state of FIG. 11A can be effected promptly. Further, the unstable motion of discharge can be precluded by repressing the spring oscillation of the movable separation membrane. The printing of an image of high quality at a high speed, therefore, can be realized.

EXAMPLE 9

The example depicted in FIGS. 12A to 12D concerns a side-shooter type liquid discharge head having a discharge port at a position opposite the heating element, whereas examples 1 to 8 described above concern liquid discharge heads having a discharge port at a position downstream from the heating element.

Now, the operation of discharge produced by this head will be described below as contrasted to the operation of the head of the first example.

Figure 12A:
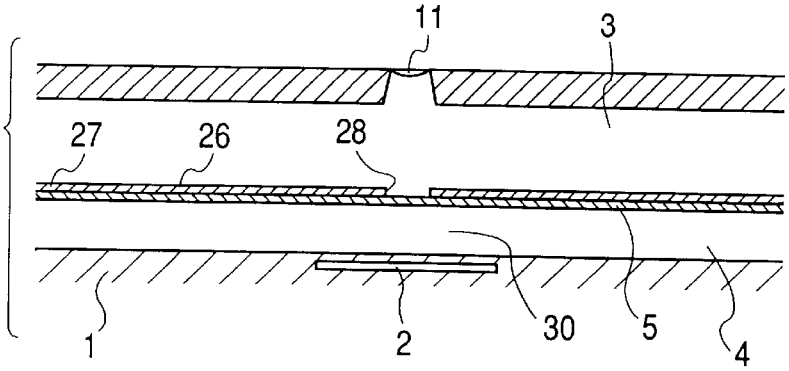
FIGS. 12A, 12B, 12C, and 12D are model diagrams of cross sections of directions of flow path for illustrating the ninth example of the liquid discharge head of the present invention.

The present liquid discharge head illustrated in FIG. 12A has a structure such that the bubble generating region 30 near the heating element 2 of the second flow path 4 generates the bubbles 40 when the heating element 2 disposed on the device substrate 1 heats the liquid held inside the bubble generating region 30 and causes the membrane to boil.

This region is substantially separated by the movable separation membrane 5 from the first flow path 3 which communicates with the discharge port 11. This structure never allows the liquid of the first flow path 3 to mingle with the liquid of the second flow path 4. The liquids of the first and the second flow path 3 and 4 may be the same or different, depending on the purpose of use.

In the present example, the two movable members 26 are separated symmetrically across the center axis of the discharge port 11 through the medium of the movable separation membrane 5 and are disposed opposite the bubble generating region 30, with the free terminals 28 thereof directed toward the discharge port.

Figure 12B:
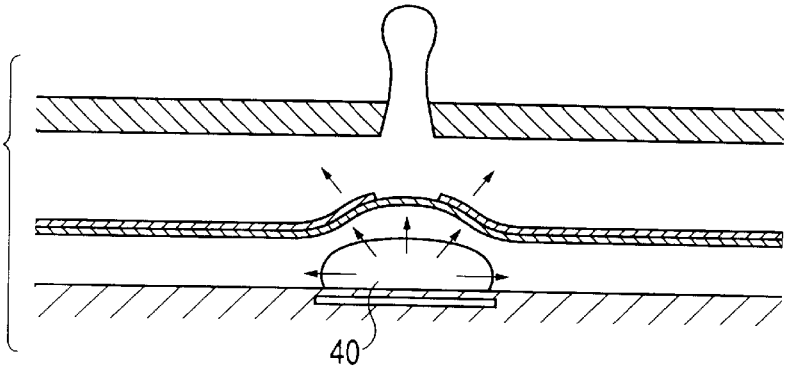

With reference to FIG. 12B, when the heating element 2 incites the bubble generating region 30 to generate the bubbles 40, the bubbles 40 expand the movable separation membrane 5. Since the two movable members 26 have their fulcrums 27 disposed on the upstream side and their free terminals 28 on the downstream side, the two free terminals 28 are largely displaced and the movable separation membrane 5 is also displaced so as to conform to the displaced shapes of the movable members 26 and expanded largely toward the discharge port. As a result, the discharge efficiency is exalted because the bubbles 40 are largely guided toward the discharge port.

Figure 12C:
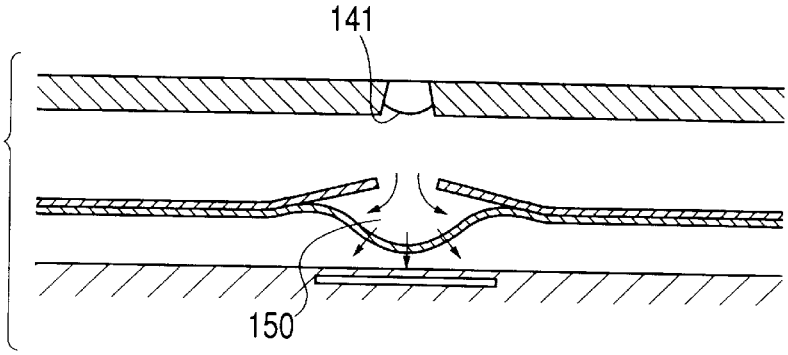

FIG. 12C illustrates the process of extinction of the bubbles 40 by shrinkage. Owing to the defoaming pressure, the movable separation membrane 5 is immediately pulled in the direction of causing extinction of the bubbles 40 and separated from the two movable members 26 and the liquid is interposed between the movable separation membrane 5 and the movable member 26. The meniscus 141 is largely dragged in because the greater part of this liquid is supplied from the free terminal sides of the movable members 26.

Figure 12D:
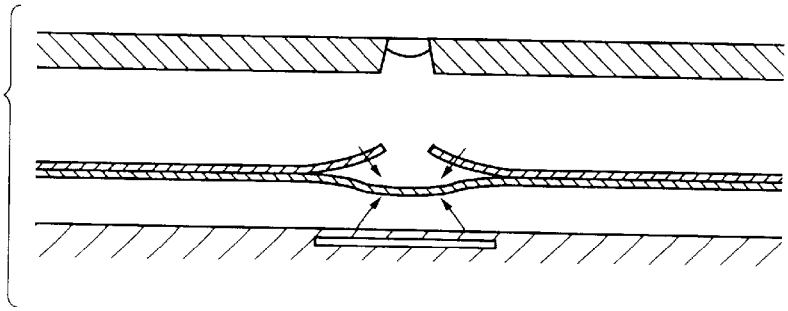

FIG. 12D illustrates the process in which the movable separation membrane 5 displaced toward the heating element side from the home position is returned to the home position by the defoaming pressure. The return to the home position of the movable separation membrane 5 which has been displaced toward the heating element side inevitably suffers occurrence of a damped oscillation when the movable separation membrane 5 abounds in elasticity. In the present example, however, the spring oscillation of the movable separation membrane 5 can be damped quickly because the liquid 150 which intervenes between the movable separation membrane 5 and the movable member 26 is enabled to function as a damper or cushion. As a result, the shift of the state of FIG. 12D through that of FIG. 12E to the initial state of FIG. 12A can be effected promptly. Further, the unstable motion of discharge due to the spring oscillation of the movable separation membrane can be precluded. The printing of an image of high quality at a high speed, therefore, can be realized.

The present example, as described above, can exalt the effect of repressing the retraction of the meniscus, enhancing the refill property, and damping the oscillation of the movable separation membrane.

Incidentally, the structures described in the second through eighth examples can be likewise applied to the present example.

The structure of the present example, as described above, can effect discharge of a discharging liquid by using two different liquids for the discharging liquid and a bubble generating liquid and allowing the pressure arising from the bubble generating of the bubble generating liquid to act on the movable separation membrane 5. Thus, even such a highly viscous liquid as polyethylene glycol which has not been sufficiently foamed and has failed to produce a sufficient discharging force in spite of exposure to heat can be discharged satisfactorily by feeding this liquid to the first flow path 3 and feeding a liquid capable of satisfactorily bubble generating the bubble generating liquid (a 4:6 mixture of ethanol:water, about 1–2 cp) to the second flow path 4.

When a liquid incapable of producing a deposit in the form of scorch on the surface of the heating element on exposure to heat is selected as the bubble generating liquid, the bubble generating can be stabilized and the discharge can be implemented satisfactorily.

Further, the structure of the head of this invention can cause discharge of a liquid of high viscosity with high discharge efficiency under a high discharge pressure because it brings about such effects as described in the modes of embodiment described above.

Even in the case of a liquid which is vulnerable to heat, this thermally vulnerable liquid is enabled to be discharged with high discharge efficiency under high discharge pressure as described above without succumbing to thermal damage by feeding this liquid as a discharging liquid to the first flow path 3 and feeding to the second flow path 4 such a liquid as is not easily degenerated thermally and is allowed to foam satisfactorily.

Now, the structure of the device substrate 1 which is provided with the heating element for applying heat to the liquid will be described below.

Figure 13A:
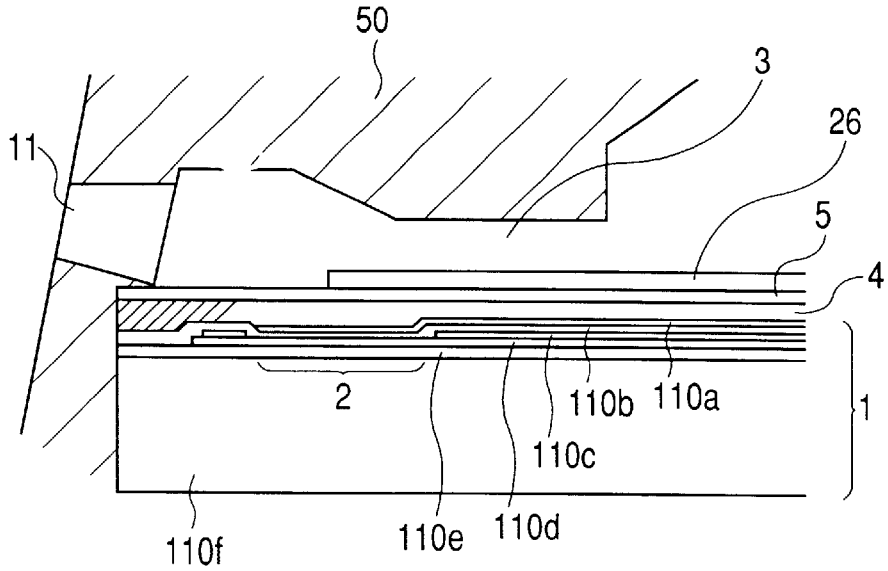
FIGS. 13A and 13B are longitudinal sections illustrating one example of the structure of the liquid discharge head of the present invention.
Figure 13B:
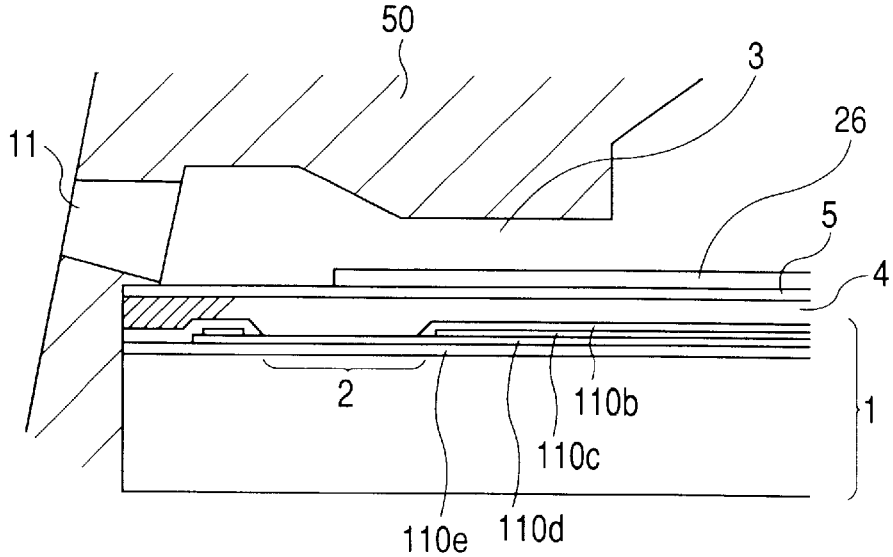

FIGS. 13A and 13B are longitudinal sections illustrating one example of the structure of the liquid discharge head of this invention; FIG. 13A a diagram depicting a head furnished with a protective membrane which will be specifically described herein below and FIG. 13B a diagram depicting a head not furnished with an anti-cavitation layer as a protective membrane.

As illustrated in FIGS. 13A and 13B, on the device substrate 1, the second flow path 4, the movable separation membrane 5 destined to serve as a separation wall, the movable member 26, the first flow path 3, and a grooved member 50 furnished with a groove destined to function as the first flow path 3 are provided.

In the device substrate 1, a silicon oxide film or silicon nitride film 110*e* aiming to offer insulation and storage of heat is formed on a base body 110*f* of silicon, for example, and an electric resistance layer 110*d*, 0.01 to 0.2 μm in thickness, of hafnium boride ($HfB_2$), tantalum nitride (TaN), or tantalum aluminum (TaAl), for example, intended to form a heating element and two wiring electrodes 110*c*, 0.2 to 1.0 μm in thickness, of aluminum, for example, are superposed thereon by patterning. The electric resistance layer 110*d* is incited to emit heat by applying a voltage from the two wiring electrode 110*c* to the electric resistance layer 110*d* thereby causing supply of an electric current to the electric resistance layer 110*d*. On the electric resistance layer 110*d* intervening between the wiring electrodes 110*c*, a protective layer 110*b*, 0.1 to 0.2 μm in thickness, of silicon oxide or silicon nitride, for example, is formed and an anti-cavitation layer 110*a*, 0.1 to 0.6 μm in thickness, of tantalum, for example, is further superposed thereon to protect the electric resistance layer 110*d* from various liquid such as ink.

Such a metallic material as tantalum (Ta), for example, is used for the anti-cavitation layer 110*a* because the pressure and the shock wave which arise during the birth and extinction of bubbles are very strong and seriously degrade the durability of rigid and brittle oxide film.

Optionally, the discharge head may be formed in such a structure by suitably combining liquids, flow path layouts, and resistance materials as obviates the anti-cavitation layer as a protective layer. One example of this structure is illustrated in FIG. 13B.

An iridium-tantalum-aluminum alloy, for example, may be cited as a material for the electric resistance layer which has no use for a protective layer. Particularly, for the sake of this invention, the absence of the protective layer proves to be rather advantageous because the bubble generating liquid is rendered fit for bubble generating by being separated from the discharging liquid.

The structure of the heating element 2 in the mode of the embodiment described above is only required to have the electric resistance layer 110*d* (heating element) interposed between the wiring electrodes 110*c*. It may otherwise incorporate therein the protective layer 110*b* for protecting the electric resistance layer 110*d*.

The present example has been depicted as adopting for the heating element 2 a heating element formed of a resistance layer which is capable of emitting heat in response to an electric signal. This invention does not need to limit the heating element 2 to this particular structure but only requires it to be capable of producing in the bubble generating liquid such bubbles as are necessary for causing discharge of the discharging liquid. As the heating element, such a photothermal converting device as emits heat on receiving the light like a laser beam or a heating device furnished with such a heating element as emits heat on receiving a high frequency may be adopted, for example.

Besides the electrothermal conversion element which is composed of the electric resistance layer 110*d* forming a heating element and the wiring electrode 110*c* for supplying an electric signal to the electric resistance layer 110*d*, the element substrate 1 mentioned above is allowed to have such functional elements as transistors, diodes, latches, and shift registers which are used for selectively driving the electrothermal conversion elements integrally incorporated therein during the process of semiconductor production.

For the purpose of discharging the liquid by driving the heating element provided in the device substrate 1 as described above, the resistance layer 110*d* interposed between the wiring electrodes is incited to generate heat promptly by applying a rectangular pulse to the electric resistance layer 110*d* via the wiring electrode 110*c*.

Figure 14:
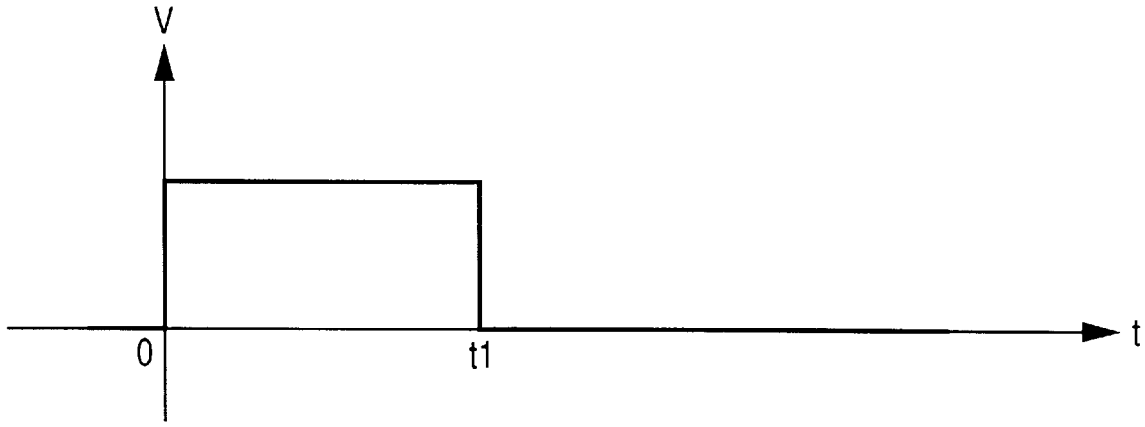
FIG. 14 is a diagram illustrating the voltage waveform to be applied to the heating element shown in FIGS. 12A through 12D.

FIG. 14 is a diagram depicting the voltage waveform to be applied to the heating element 2 in the form of an electric resistance layer illustrated in FIGS. 13A and 13B.

In the head contemplated by the example described above, the heating element is set driving by the application thereto of an electric signal at 6 kHz under the conditions of 24 V of voltage, 7 μsec of pulse width, and 150 mA of electric current and, in consequence of the operation performed as described above, an ink as a liquid wished to be discharged is discharged through the discharge port. The conditions for the drive signal in this invention do not need to be limited to those mentioned above. The drive signal is only required to be capable of causing the bubble generating liquid to foam perfectly.

An example of the structure of a liquid discharge head which possesses two common liquid chambers, allows introduction of different liquids as perfectly separated to the common liquid chambers, permits a reduction in cost, and promises a cut in the number of component parts will be described below.

Figure 15:
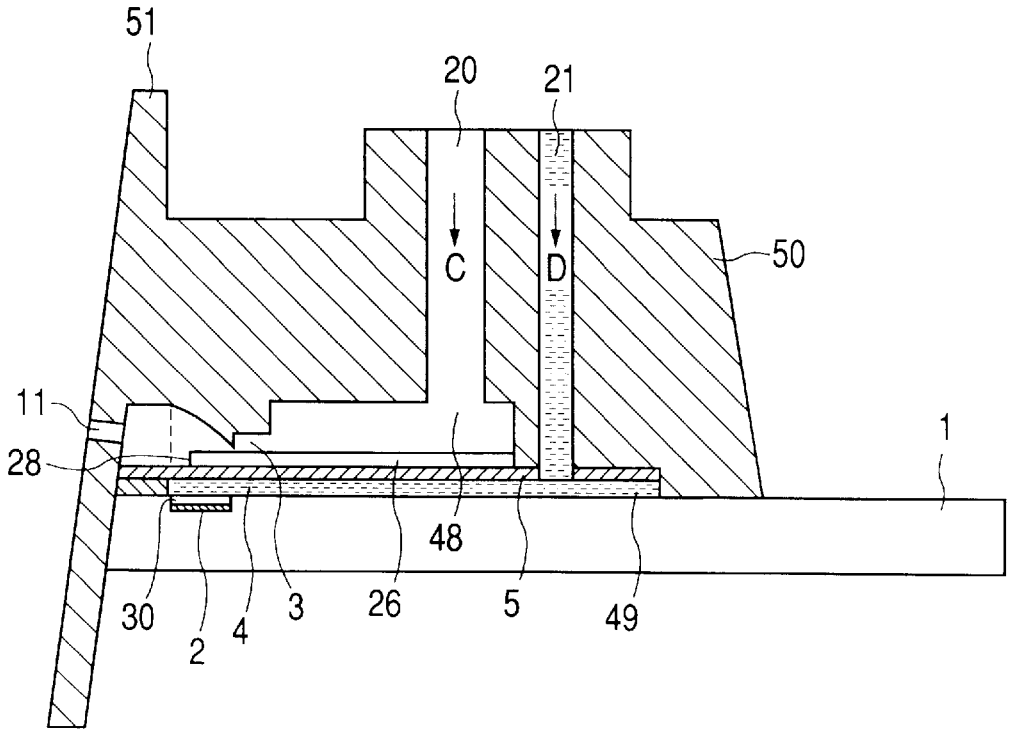
FIG. 15 is a model diagram illustrating an example of the structure of the liquid discharge head of the present invention.

FIG. 15 is a model diagram illustrating one example of the structure of the liquid discharge head according to this invention. In this diagram, like component parts shown in FIGS. 1A to 1E through 13A and 13B are denoted by like reference numerals. These component parts will be omitted from the following detailed description.

The grooved member 50 in the liquid discharge head illustrated in FIG. 15 is roughly composed of an orifice plate 51, a plurality of grooves destined to form as many first flow paths 3, and a depressed part destined to form a first common liquid chamber 48 adapted to communicate simultaneously with the plurality of first flow paths 3 and supply a liquid (discharging liquid) to these first flow paths 3.

The plurality of first flow paths 3 are formed by joining the movable separation membrane 5 to the lower side part of the grooved member 50. The grooved member 50 is provided with the first liquid feeding path 20 extending from the upper part of the grooved member 50 into the first common liquid chamber 48 and also with the second liquid feeding path 21 extending from the upper part of the grooved member 50 through the movable separation membrane 5 into a second common liquid chamber 49.

On the movable separation membrane 5, the movable member 26 is disposed as opposed to the bubble generating region 30 with the free terminal 28 thereof laid in the direction of the discharge port. The free terminal of the movable member is positioned on the discharge port side from the center of the area of the heating element 2.

The first liquid (discharging liquid) is fed, as shown by the arrow mark C in FIG. 15, to the first flow path 3 through the first liquid feeding path 20 and the first common liquid chamber 48 and the second liquid (bubble generating liquid) is fed, as shown by the arrow mark D in FIG. 15, to the second flow path 4 through the second liquid feeding path 21 and the second common liquid chamber 49.

In the present example, the second liquid feeding path 21 is disposed parallelly to the first liquid feeding path 20. This invention does not need to limit the disposition of the second liquid feeding path 21 to this particular layout. It may adopt any arbitrary layout in which the second liquid feeding path 21 penetrates the movable separation membrane 5 disposed outside the first common liquid chamber 48 and communicates with the second common liquid chamber 49.

The thickness (diameter) of the second liquid feeding path 21 is decided in consideration of the amount of the second liquid to be supplied and the shape of the second liquid feeding path 21 does not need to have a circular cross section but may be in a rectangular cross section instead.

The second common liquid chamber 49 may be formed by partitioning the grooved member 50 with the movable separation membrane 5. As respects the method for effecting this formation, the second common liquid chamber 49 and the second liquid feeding path 4 may be formed by forming a common liquid chamber frame and a second flow path wall with dry film on the substrate 1 and pasting to the substrate 1 the union of the grooved member 50 serving to fix the movable separation membrane 5 and the movable separation membrane 5.

Figure 16:
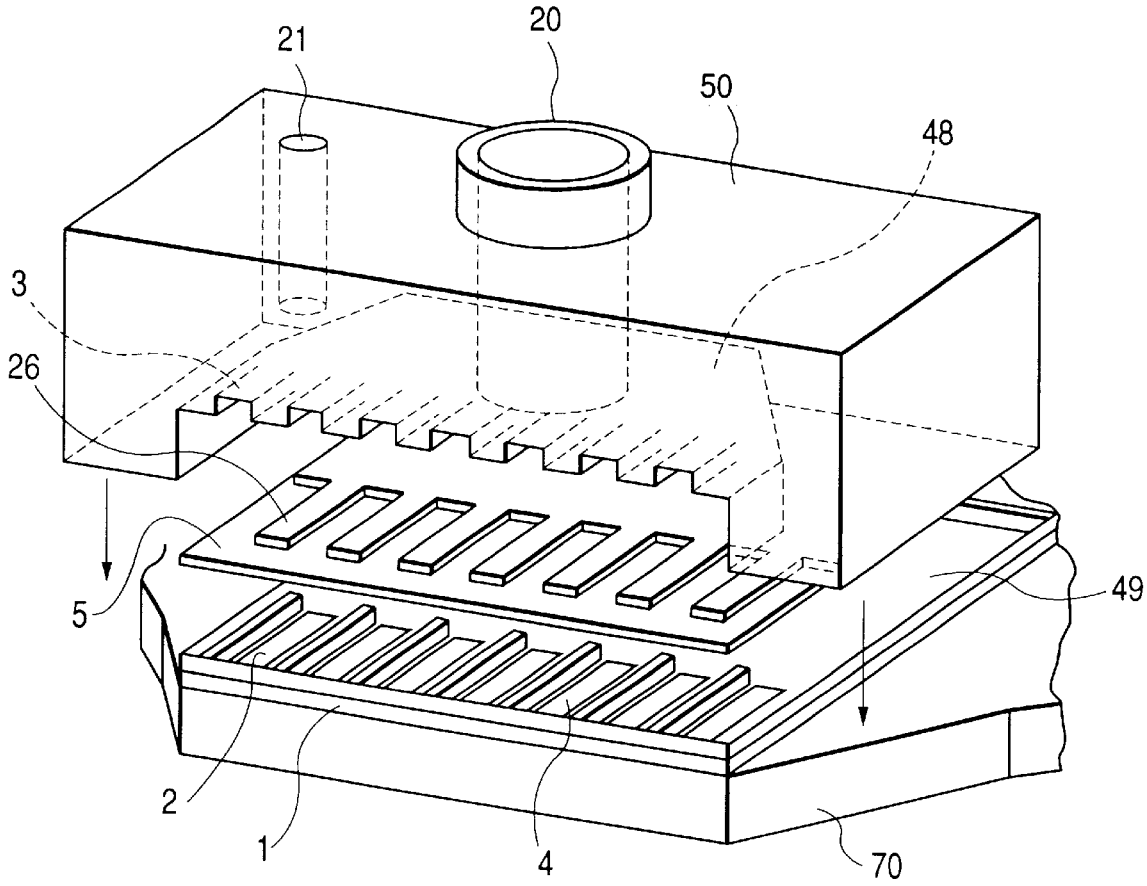
FIG. 16 is an exploded perspective view illustrating an example of the structure of the liquid discharge head of the present invention.

FIG. 16 is an exploded perspective view illustrating one example of the structure of the liquid discharge head of this invention.

The present embodiment contemplates providing the device substrate 1 which has a plurality of electrothermal conversion elements intended as the heating element 2 for generating the heat required in inciting the bubble generating liquid to produce bubbles by membrane boiling and superposed as described above on a supporting member 70 formed of such a metal as aluminum.

On the device substrate 1, a plurality of grooves destined to form the second flow paths 4 defined by second flow path walls, a depressed part destined to form the second common liquid chamber (common bubble generating liquid chamber) 49 communicating with the plurality of second flow paths 4 and feeding the bubble generating liquid to the second flow paths 4, and the movable separation membrane 5 furnished with the movable member 26 mentioned above are provided.

The grooved member 50 is provided with grooves destined to form the first flow path (discharging liquid flow path) 3 by being joined to the movable separation membrane 5, a depressed part destined to form the first common liquid chamber (common discharging liquid chamber) 48 communicating with the discharge liquid flow paths and feeding the discharging liquid to the first flow paths 3, the first liquid feeding path (discharging liquid feeding path) 20 for feeding the discharging liquid to the first common liquid chamber 48, and the second liquid feeding path (bubble generating liquid feeding path) 21 for feeding the bubble generating liquid to the second common liquid chamber 49. The second liquid feeding path 21 is passed through the movable separation membrane 5 disposed outside the first common liquid chamber 48 and joined to the path communicating with the second common liquid chamber 49 and, by virtue of this communicating path, enabled to feed the bubble generating liquid to the second common liquid chamber 48 without being mixed with the discharging liquid.

As respects the relation of layout of the device substrate 1, the movable separation membrane 5, and the grooved top plate 50, the movable member 26 is disposed correspondingly to the heating element 2 of the device substrate 1 and the first flow path 3 is installed correspondingly to the movable member 26. While the present mode of embodiment is depicted as providing the second liquid feeding path 21 for one grooved member 50, it does not preclude provision of a plurality of such second liquid feeding paths, depending on the amount of liquid to be fed. The cross sections of the first liquid feeding path 20 and the second liquid feeding path 21 may be decided proportionately to the amounts of liquid wished to be fed. The component parts of the grooved member 50, for example, may be reduced in size by optimizing the cross sections of these feeding paths.

According to the present mode of embodiment, the number of component parts can be decreased, the process of operation shortened, and the cost of operation cut owing to the fact that the second liquid feeding path 21 for feeding the second liquid to the second flow path 4 and the first liquid feeding path 20 for feeding the first liquid to the first flow path 3 are formed by one and the same grooved top plate as the grooved member 50.

Since the supply of the second liquid to the second common liquid chamber 49 which communicates with the second flow path 4 is effected with the second flow path 4 in the direction piercing the movable separation membrane 5 separating the first and the second liquid, the process of pasting the movable separation membrane 5, the grooved member 50, and the substrate 1 having the heating element 2 formed thereon can be accomplished all at once. Thus, the ease of fabrication is improved, the precision of pasting enhanced, and the efficiency of discharge exalted.

The supply of the second liquid to the second flow path 4 is effected infallibly because the second liquid is fed through the movable separation membrane 5 to the second common liquid chamber 49. The discharge of liquid is attained stably because ample supply of the liquid is ensured.

Owing to the structure incorporating therein the movable separation membrane 5 which is provided with the movable member as described above, the liquid discharge head of this invention enables the liquid to be discharged with a higher discharge force or discharge efficiency at a higher speed than the conventional liquid discharge head. The bubble generating liquid to be used may be a liquid of such quality as specified above. As concrete examples of the bubble generating liquid fit for use herein, methanol, ethanol, n-propanol, isopropanol, n-hexane, n-heptane, n-octane, toluene, xylene, methylene dichloride, triclene, Freon TF, Freon BF, ethyl ether, dioxane, cyclohexane, methyl acetate, ethyl acetate, acetone, methylethyl ketone, water, and mixtures thereof may be cited.

As the discharging liquid, a varying liquid may be used without reference to foamability and thermal properties. Even a liquid of poor foamability, a liquid readily degenerated or deteriorated by heat, or a liquid of unduly high viscosity which has not been easily discharged by the conventional discharge head can be effectively utilized.

As the quality proper for any discharging liquid, the discharging liquid to be used herein is preferred to avoid interfering with the action of discharging or bubble generating or with the operation of the movable separation membrane or the movable member owing to the reaction of its own or with the bubble generating liquid.

As the discharging liquid for recording, a highly viscous ink may be utilized.

Besides, such liquids as medicines and perfumes which are vulnerable to heat may be utilized.

Bubble generating liquids and discharging liquids of the following compositions were used in varying combinations to effect discharge of the discharging liquids and produce records. A review of the records reveals that not only liquids of a viscosity of ten-odd cp which were not easily discharged with the conventional head but also liquids of such very high viscosity as 150 cp could be discharged satisfactorily to produce records of high image quality.

| | | |
|---|---|---|
| Bubble generating liquid 1 - | Ethanol | 40 wt. % |
| | Water | 60 wt. % |
| Bubble generating liquid 2 - | Water | 100 wt. % |
| Bubble generating liquid 3 - | Isopropyl alcohol | 10 wt. % |
| | Water | 90 wt. % |
| Discharging liquid 1 - Carbon | black | 5 wt. % |

(Pigment ink about 15 cp) Styrene-acrylic acid-ethyl acrylate copolymer dispersion agent (oxidation 140, weight average molecular weight 8000)

| | |
|---|---|
| | 1 wt. % |
| Monoethanol amine | 0.25 wt. % |
| Glycerin | 6.9 wt. % |
| Thiodiglycol | 5 wt. % |
| Ethanol | 3 wt. % |
| Water | 16.75 wt. % |

Discharging liquid 2 (55 cp) Polyethylene glycol 200 100 wt. %

Discharging liquid 3 (150 cp) Polyethylene glycol 600 100 wt. %

Incidentally, in the case of a liquid heretofore held to be discharged only with difficulty, the low discharge speed aggravated the dispersion of the directionality of discharge and impaired the precision of landing of dots on a recording paper and the unstability of discharge resulted in dispersing the amount of discharge and consequently rendering difficulty the production of an image of high quality. In the structure according to the mode of embodiment described above, however, the generation of bubbles could be attained amply and stably by the use of the bubble generating liquid. This fact allowed improvement of the precision of landing of liquid drops and stabilization of the amount of ink discharge and conspicuously improved the quality of a recorded image.

Now, the process for the production of the liquid discharge head of this invention will be described below.

Broadly, the manufacture of the head was effected by forming the wall of a second flow path on the device substrate, fitting thereon the movable separation membrane furnished with the movable member, and fitting further thereon the grooved member containing a groove for forming the first flow path. Otherwise, it was attained by forming the wall of the second flow path and then joining onto the wall the grooved member having fitted thereto the movable separation membrane furnished with the movable member.

The method for manufacturing the second flow path will be described more specifically below.

First, the electrothermal conversion element furnished with the heating element made of hafnium boride or tantalum nitride was formed on the device substrate (silicon wafer) by the use of the same device of manufacture as that used for a semiconductor and then the surface of the device substrate was cleaned for the purpose of improving the tight adhesion of the surface to a photosensitive resin in the subsequent step. For further improving the tight adhesion, it suffices to subject the surface of the device substrate to a treatment with ultraviolet light and oregion and then apply to the treated surface by spin coating a solution obtained by diluting a silane coupling agent (made by Nihon Unica K.K. and sold under the product code of "A189") to a concentration of 1 wt. % with ethyl alcohol.

Then, the resultant surface was cleaned and an ultraviolet-sensitive resin film (made by Tokyo Ohka K.K. and sold under the trademark designation of "Dry Film Odil SY-318") DF was laminated on the substrate having the tight adhesion thereof improved.

Subsequently, a photomask PM was laid on the dry film DF and the portion of the dry film DF required to remain as a second flow path wall was exposed to the ultraviolet light through the photomask PM. This step of exposure was effected by the use of an instrument (made by Canon Inc. and sold under the product code of "MPA-600") with an exposure of about 600 mJ/cm$^2$.

The dry film DF was then developed with a developer (made by Tokyo Ohka K.K. and sold under the product code of "BMRC-3") formed of a mixture of xylene with butyl cellosolve acetate to dissolve out the unexposed part and obtain the exposed and hardened part as the wall part of the second flow path 4. The residue still persisting on the surface of the device substrate 1 was removed by about 90 seconds' treatment with a plasma ashing device (produced by Alukantec Inc. and sold under the product code of "MAS-800"). The substrate was subsequently exposed to the ultraviolet light projected at a rate of 100 mJ/cm$^2$ at 150° C. for two hours to harden perfectly the exposed part.

The second flow paths could be formed with high precision uniformly on a plurality of heater boards (device substrates) fabricated as cut from the silicon substrate by the method described above. Specifically, the silicon substrate was cut into the individual heater boards 1 with the dicing machine (made by Tokyo Seimitsu K.K. and sold under the product code of "AWD-4000") fitted with a diamond plate, 0.05 mm in thickness. The separated heater boards 1 were fixed with an adhesive agent (made by Toray Industries, Inc. and sold under the product code of "SE4400") on an aluminum base plate.

Then, the print substrate joined in advance to the aluminum base plate and connected to the heater boards with an aluminum wire, 0.05 mm in diameter.

Subsequently, the unions resulting from joining the grooved members joined to the movable separation membranes were joined as aligned to the heater boards obtained as described above. To be specific, the grooved members furnished with the movable separation membranes and the heater boards were aligned to each other and joined and fixed with a rebound leaf. Then, ink bubble generating liquid feeding members were joined and fixed on the aluminum base plates. The gaps between the aluminum wires and the gaps between the grooved member, the heater boards, and the ink·bubble generating liquid feeding members were sealed with a silicone sealer (made by Toshiba Silicone K.K. and sold under the product code of "TSE399") to complete the manufacture.

By forming the second flow paths in accordance with the method of production described above, the flow paths can be obtained with high precision without any positional deviation from the heaters of the heater boards mentioned above. Particularly by having the grooved members and the movable separation membranes joined in advance to each other in the preceding step, the positional precision of the first flow paths and the movable members can be exalted. The high-precision production technique described above stabilizes the discharge of liquid and improves the quality of print. Further, the fact that the component parts are formed collectively on the wafer permits quantity production of the liquid discharge heads at a low cost.

The present mode of embodiment has been depicted as using an ultraviolet hardening type dry film for the formation of the second flow paths. Otherwise, the formation of the second flow paths may be attained by adopting a resin having an absorption band near the ultraviolet region, particularly a region of 248 nm, laminating the resin, hardening the resultant laminate, and directly removing the part of the laminate wished to form the second flow path with an excimer laser.

The materials which are preferably used for the movable members include such metals as silver, nickel, gold, iron, titanium, aluminum, platinum, tantalum, stainless steel, and phosphor bronze which abound in durability and alloys of these metals, resins such as acrylonitrile, butadiene, and styrene which have a nitrile group, resins such as polyamides which have an amide group, resins such as polycarbonate which have a carboxyl group, resins such as polyacetal which have an aldehyde group, resins such as polysulfones which have a sulfone group, other resins such as liquid crystal polymers and compounds thereof, metals such as gold, tungsten, tantalum, nickel, stainless steel, and titanium which offer high resistance to inks, alloys of these metals, materials coated with these metals or alloys for the sake of resistance to inks, resins such as polyamides which have an amide group, resins such as polyacetals which have an aldehyde group, resins such as polyether ether ketones which have a ketone group, resins such as polyimides which have an imide group, resins such as phenol resins which have a hydroxyl group, resins such as polyethylenes which have an ethyl group, resins such as epoxy resins which have an epoxy group, resins such as melamine resins which have an amino group, resins such as xylene resins which have a methylol group, and compounds thereof, and ceramics such as silicon dioxide, and compounds thereof, for example.

The materials which are preferably used for the movable separation membranes include such engineering plastics of the recent development as, for example, polyethylene, polypropylene, polyamide, polyethylene terephthalate, melamine resins, phenol resins, polybutadiene, polyurethane, polyether ether ketone, polyether sulfones, polyarylate, silicone rubber, and polysulfones which excel in resistance to heat, resistance to solvents, and moldability, exhibit elasticity, and permit production of thin films, and compounds of the plastics in addition to the polyimides mentioned above.

The thickness of the movable separation membrane 25 may be decided in consideration of the material, shape, etc. of the membrane from the viewpoint of attaining the strength proper for any separation wall and producing the actions of expansion and contraction satisfactorily. Generally, this thickness is preferred to fall in the approximate range of 0.5–10 $\mu$m.

Since this invention is constructed as described above, it manifests the following effects.

(1) The liquid can be discharged efficiently with high discharging force through the discharge port because the movable separation membrane disposed on the bubble generating region is expanded by the pressure produced in consequence of the generation of bubbles and the movable member disposed on the movable separation membrane is consequently displaced toward the first flow path to guide the pressure in the direction of the discharge port on the first flow path side.

(2) Since the flow path for passing the discharging liquid and the flow path for passing the bubble generating liquid are separated from each other by the movable separation membrane, the discharging liquid does not flow in the flow path which is furnished with the heating element. Even when the discharging liquid which is used happens to be made of a material vulnerable to heat, the amount of a deposit suffered to pile on the heating element can be decreased and the freedom of selection of the discharging liquid can be widened.

(3) During the extinction of the bubbles, the movable separation membrane and the movable member are separated from each other and the liquid is interposed therebetween and allowed to function as a damper. Thus, the oscillation produced by the movable separation membrane during the return of the movable separation membrane to the home position can be repressed and the otherwise possible unstable action of discharge can be precluded. The printing of an image of high quality, therefore, can be realized.

(4) When the free terminal of the movable member falls on the upstream side from the discharging port side terminal of the heating element, the supply of the liquid to be interposed between the movable separation membrane and the movable member during the extinction of bubbles is promoted and the retraction of the meniscus is repressed. As a result, the refill property is improved enough to ensure stable discharge of liquid even in the printing performed at a high speed.

(5) When the liquid is supplied from the liquid intrusion promoting structure provided on the fulcrum side of the movable member, the supply of the liquid from the free terminal side of the movable member is repressed. As a result, the retraction of the meniscus is repressed and the refill property is improved. Further, the oscillation produced by the movable separation membrane can be also repressed because the region of the movable member which functions as a damper is large. The printing of an image of high quality at a high speed, therefore, can be realized.

(6) The method which effects the separation of the movable separation membrane and the movable member during the extinction of the bubbles allows the movable separation membrane to enjoy improved durability because it avoids restricting the independent motions of the movable separation membrane and the movable member.

What is claimed is:

1. A method for the discharge of a liquid, comprising the steps of:

effecting said discharge of liquid by causing a movable separation membrane which constantly keeps in a substantially separated state a first flow path adapted to discharge a liquid and communicate with a discharge port and a second flow path provided with a bubble generating region for generating a bubble in a liquid to be displaced with the bubble on an upstream side of said discharge port relative to a flow of the liquid in said first flow path, and restraining a meniscus of liquid from retracting relative to a displacement of said movable separation membrane in response to an expansion and contraction of the bubble using a regulating member.

2. A method according to claim 1, wherein a step of interposing a liquid between said movable separation membrane and said regulating member contacting a displacing region of said movable separation membrane and possessing a free terminal on the discharge port side restraining the displacement of said movable separation membrane while said movable separation membrane and said regulating member are in an at least partly separated state is contained during retraction of said meniscus.

3. A method according to claim 2, wherein said movable separation membrane and said regulating member, are separated from each other during the contraction of the bubble and the liquid is interposed therebetween to effect the return to the home position.

4. A method according to claim 1, wherein said movable separation membrane and said regulating member are separated from each other during the contraction of the bubble and the liquid is interposed therebetween to effect return to the home position.

5. A method for the discharge of a liquid, comprising the steps of:

effecting said discharge of liquid by causing a movable separation membrane which constantly keeps in a substantially separated state a first flow path adapted to discharge a liquid and communicating with a discharge port and a second flow path provided with a bubble generating region for generating a bubble in a liquid to be displaced with the bubble on an upstream side of said discharge port relative to a flow of the liquid in said first flow path;

restraining a meniscus of liquid from retracting relative to a displacement of said movable separation membrane in response to expansion and contraction of the bubble by means of a regulating member; and interposing a liquid between said movable separation membrane and said regulating member contacting a displacing region of said movable separation membrane and possessing a free terminal on the discharge port side restraining the displacement of said movable separation membrane while said movable separation membrane and said regulating member are in an at least partly separated state is contained during retraction of said meniscus, wherein said movable separation membrane and said regulating member are separated from each other during the contraction of the bubble and the liquid is interposed therebetween to effect return to the home position, and wherein a liquid intrusion promoting structure disposed in said regulating member enables the liquid to intrude between said movable separation membrane and said movable member.

6. A liquid discharge head, comprising:

a first flow path adapted to discharge a liquid and communicate with a discharge port, a second flow path having a bubble generating region for generating a bubble in a liquid, a movable separation membrane for effecting substantial separation between said first and said second flow path and operating to effect discharge of said liquid by displacing said movable separation membrane with the bubble on an upstream side of said discharge port relative to a flow of said liquid in said first flow path, and a regulating member for restraining retraction of a meniscus of said liquid relative to a displacement of said movable separation membrane in response to the growth and contraction of the bubble.

7. A liquid discharge head according to claim 6, which is provided with said regulating member contacting the displacing region of said movable separation membrane and possessing a free terminal on the discharge port side regulating the displacement of said movable separation membrane and a device for regulating an amount of relative motion of said movable separation membrane and said regulating member.

8. A liquid discharge head comprising:

a movable separation membrane for substantially separating a bubble generating region for generating a bubble in a liquid and a liquid discharging region communicating with a discharge port for discharging a liquid, an energy generating device for causing generation of the bubble in said bubble generating region, and a movable member opposed to said bubble generating region across said movable separation membrane and having a free terminal in a direction of said discharge port, wherein said movable separation membrane and said movable member are separated from each other during contraction of the bubble.

9. A liquid discharge head according to claim 8, wherein said movable member is disposed so that the free terminal thereof approximates closely to the discharge port until the free end contacts said meniscus.

10. A liquid discharge head according to claim 9, wherein said movable member is retained in a tilted state within said first flow path.

11. A liquid discharge head according to claim 9, wherein said movable separation membrane and said discharge port are opposed to each other.

12. A liquid discharge head according to claim 8, wherein said free terminal of said movable member is disposed on the upstream side from a point directly above the discharge port side of said energy generating device.

13. A liquid discharge head according to claim 12, wherein said movable member is retained in a tilted state within said first flow path.

14. A liquid discharge head according to claim 12, wherein said movable separation membrane and said discharge port are opposed to each other.

15. A liquid discharge head according to claim 8, wherein said movable member is retained in a tilted state within said first flow path.

16. A liquid discharge head according to claim 15, wherein movable separation membrane and said discharge port are opposed to each other.

17. A liquid discharge head according to claim 8, wherein said movable separation membrane and said discharge port are opposed to each other.

18. A liquid discharge head comprising:

a movable separation membrane for substantially separating a bubble generating region for generating a bubble in a liquid and a liquid discharging region communicating with a discharge port for discharging a liquid;

an energy generating device for causing generation of the bubble in said bubble generating region; and a movable member opposed to said bubble generating region across said movable separation membrane and having a free terminal in a direction of said discharge port, wherein said movable separation membrane and said movable member are separated from each other during contraction of the bubble, and wherein said movable member has a liquid intrusion promoting structure for effecting the intrusion of a liquid between said movable separation membrane and said movable member.

19. A liquid discharge head according to claim 18, wherein said liquid intrusion promoting structure is a feed opening provided in said movable member.

20. A liquid discharge head according to claim 19, wherein said movable member is retained in a tilted state within said first flow path.

21. A liquid discharge head according to claim 19, wherein said movable separation membrane and said discharge port are opposed to each other.

22. A liquid discharge head according to claim 18, wherein said liquid intrusion promoting structure is a tight adhesion preventing structure for precluding tight adhesion between said movable member and said movable separation membrane.

23. A liquid discharge head according to claim 22, wherein said liquid intrusion promoting structure is a convex point provided in a region in which said movable member contacts said movable separation membrane.

24. A liquid discharge head according to claim 23, wherein said movable member is retained in a tilted state within said first flow path.

25. A liquid discharge head according to claim 23, wherein said movable separation membrane and said discharge port are opposed to each other.

26. A liquid discharge head according to claim 22, wherein said liquid intrusion promoting structure is a liquid inflow groove provided on the movable separation membrane side of said movable member.

27. A liquid discharge head according to claim 26, wherein said movable member is retained in a tilted state within said first flow path.

28. A liquid discharge head according to claim 26, wherein said movable separation membrane and said discharge port are opposed to each other.

29. A liquid discharge head according to claim 22, wherein said movable member is retained in a tilted state within said first flow path.

30. A liquid discharge head according to claim 22, wherein said movable separation membrane and said discharge port are opposed to each other.

31. A liquid discharge head according to claim 18, wherein said movable member is retained in a tilted state within said first flow path.

32. A liquid discharge head according to claim 18, wherein said movable separation membrane and said discharge port are opposed to each other.

33. A method for the discharge of a liquid, comprising the steps of:

effecting said discharge of liquid by causing a movable separation membrane which constantly keeps in a substantially separated state a first flow path adapted to discharge a liquid and communicate with a discharge port and a second flow path provided with a bubble generating region for generating a bubble in a liquid to be displaced with the bubble on an upstream side of said discharge port relative to a flow of the liquid in said first flow path;

restraining a meniscus of liquid from retracting relative to a displacement of said movable separation membrane in response to an expansion and contraction of the bubble by means of a regulating member;

interposing a liquid between said movable separation membrane and said regulating member contacting a displacing region of said movable separation membrane and possessing a free terminal on the discharge port side restraining the displacement of said movable separation membrane while said movable separation membrane and said regulating member are in an at least partly separated state during retraction of said meniscus, wherein said movable separation membrane and said regulating member are separated from each other during the contraction of the bubble and the liquid is interposed therebetween to effect the return to the home position, and wherein a liquid intrusion promoting structure disposed in said movable member enables the liquid to intrude between said movable separation membrane and said movable member.

34. A liquid discharge head comprising:

a movable separation membrane for substantially separating a bubble generating region for generating a bubble in a liquid and a liquid discharging region communicating with a discharge port for discharging a liquid;

an energy generating device for generating the bubble in said bubble generating region; and a movable member opposed to said bubble generating region across said movable separation membrane and having a free terminal in a direction of said discharge port, wherein said movable separation membrane and said movable member are separated from each other during contraction of the bubble, wherein said movable member is disposed so that the free terminal thereof approximates closely to the discharge port until the free end contacts said meniscus, and wherein said movable member has a liquid intrusion promoting structure for effecting the intrusion of a liquid between said movable separation membrane and said movable member.

35. A liquid discharge head according to claim 34, wherein said liquid intrusion promoting structure is a feed opening provided in said movable member.

36. A liquid discharge head according to claim 34, wherein said liquid intrusion promoting structure is a tight adhesion preventing structure for precluding tight adhesion between said movable member and said movable separation membrane.

37. A liquid discharge head comprising:

a movable separation membrane for substantially separating a bubble generating region for generating a bubble in a liquid and a liquid discharging region communicating with a discharge port for discharging a liquid;

an energy generating device for causing generation of the bubble in said bubble generating region; and a movable member opposed to said bubble generating region across said movable separation membrane and having a free terminal in a direction of said discharge port, wherein said movable separation membrane and said movable member are separated from each other during contraction of the bubble, and wherein said free terminal of said movable member is disposed on an upstream side from a point directly above a discharge port side of said energy generating device, and wherein said movable member has a liquid intrusion promoting structure for effecting the intrusion of a liquid between said movable separation membrane and said movable member.

38. A liquid discharge head according to claim 37, wherein said liquid intrusion promoting structure is a feed opening provided in said movable member.

39. A liquid discharge head according to claim 37, wherein said liquid intrusion promoting structure is a tight adhesion preventing structure for precluding tight adhesion between said movable member and said movable separation membrane.

* * * * *

UNITED STATES PATENT AND TRADEMARK OFFICE

CERTIFICATE OF CORRECTION

PATENT NO. : 6,286,940 B1
DATED : September 11, 2001
INVENTOR(S) : Hiroyuki Sugiyama et al.

It is certified that error appears in the above-identified patent and that said Letters Patent is hereby corrected as shown below:

Column 4,
Line 54, “contact” should read -- contacts --.

Column 5,
Line 50, “liquid for” should read -- liquid --.

Column 7,
Line 37, “the displacing” should read -- there is located the displacing --.

Column 9,
Line 15, “donwstream” should read -- downstream --; and
Line 34, “are” should read -- is --.

Column 19,
Line 1, “inevitable” should read -- inevitably --.

Column 20,
Line 62, “13A” should read -- 13A is --; and
Line 65, “13B” should read -- 13B is --.

Column 21,
Line 25, “liquid” should read -- liquids --.

Column 25,
Line 35, “culty” should read -- cult --.

Column 26,
Line 39, “substrate” should read -- substrate was --.

Column 29,
Line 33, “is contained” should be deleted.

UNITED STATES PATENT AND TRADEMARK OFFICE

CERTIFICATE OF CORRECTION

PATENT NO. : 6,286,940 B1
DATED : September 11, 2001
INVENTOR(S) : Hiroyuki Sugiyama et al.

It is certified that error appears in the above-identified patent and that said Letters Patent is hereby corrected as shown below:

Column 30,
Line 38, “wherein” should read -- wherein said --.

Signed and Sealed this

Nineteenth Day of November, 2002

*Attest:*

*Attesting Officer*

JAMES E. ROGAN
*Director of the United States Patent and Trademark Office*